US010197933B2

(12) United States Patent
Nakashima et al.

(10) Patent No.: US 10,197,933 B2
(45) Date of Patent: Feb. 5, 2019

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Shinya Nakashima, Kanagawa (JP); Akira Matsumoto, Kanagawa (JP); Yasuo Kadokura, Kanagawa (JP); Yukiaki Nakamura, Kanagawa (JP); Satoshi Miura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/489,204

(22) Filed: Apr. 17, 2017

(65) Prior Publication Data

US 2018/0059561 A1 Mar. 1, 2018

(30) Foreign Application Priority Data

Aug. 26, 2016 (JP) ..... 2016-166101

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 15/08*** | (2006.01) |

(52) U.S. Cl.

CPC ..... *G03G 9/08755* (2013.01); *G03G 9/0804* (2013.01); *G03G 9/0819* (2013.01); *G03G 9/0821* (2013.01); *G03G 9/08795* (2013.01); *G03G 9/08797* (2013.01); *G03G 9/0918* (2013.01); *G03G 15/0822* (2013.01); *G03G 15/0865* (2013.01)

(58) Field of Classification Search

CPC ..... G03G 9/08755; G03G 9/08797

See application file for complete search history.

(56) References Cited

U.S. PATENT DOCUMENTS

| | | | | |
|---|---|---|---|---|
| 7,713,669 | B2 | 5/2010 | Mizutani et al. | |
| 2011/0052882 | A1* | 3/2011 | Gong | G03G 9/0812 428/195.1 |
| 2015/0177630 | A1* | 6/2015 | Umeda | G03G 9/0815 430/137.1 |
| 2015/0177634 | A1* | 6/2015 | Kamae | G03G 9/08748 430/108.4 |

FOREIGN PATENT DOCUMENTS

| | | |
|---|---|---|
| JP | 2006-251564 A | 9/2006 |
| JP | 2007-072333 A | 3/2007 |
| JP | 2015-135486 A | 7/2015 |

* cited by examiner

*Primary Examiner* — Peter L Vajda

(74) *Attorney, Agent, or Firm* — Oliff PLC

(57) ABSTRACT

An electrostatic charge image developing toner includes toner particles including an amorphous resin and a crystalline resin, wherein, when the toner particles are subjected to a measurement by differential scanning calorimetry (DSC) before and after being stored at a temperature of 50° C. and a humidity of 90% RH for 24 hours, a relationship between an onset temperature T1 (° C.) of an endothermic peak having the lowest peak temperature in a first heating step with respect to the toner particles before being stored and an onset temperature T2 (° C.) of an endothermic peak having the lowest peak temperature in a first heating step with respect to the toner particles after being stored satisfies Expression (1): $2<T2-T1<10$.

9 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2016-166101 filed Aug. 26, 2016.

BACKGROUND

1. Technical Field

The present invention relates to an electrostatic charge image developing toner, an electrostatic charge image developer, and a toner cartridge.

2. Related Art

In the electrophotographic image forming, toners are used as image forming materials, and, for example, a toner including toner particles including a binder resin and a colorant, and an external additive that is externally added to the toner particles is widely used.

SUMMARY

According to an aspect of the invention, there is provided an electrostatic charge image developing toner including:

toner particles including an amorphous resin and a crystalline resin, wherein, when the toner particles are subjected to a measurement by differential scanning calorimetry (DSC) before and after being stored at a temperature of 50° C. and a humidity of 90% RH for 24 hours, a relationship between an onset temperature T1 (° C.) of an endothermic peak having the lowest peak temperature in a first heating step with respect to the toner particles before being stored and an onset temperature T2 (° C.) of an endothermic peak having the lowest peak temperature in a first heating step with respect to the toner particles after being stored satisfies Expression (1): $2<T2-T1<10$.

BRIEF DESCRIPTION OF THE DRAWINGS

Exemplary embodiments of the present invention will be described in detail based on the following figures, wherein.

DETAILED DESCRIPTION

Figure 1:
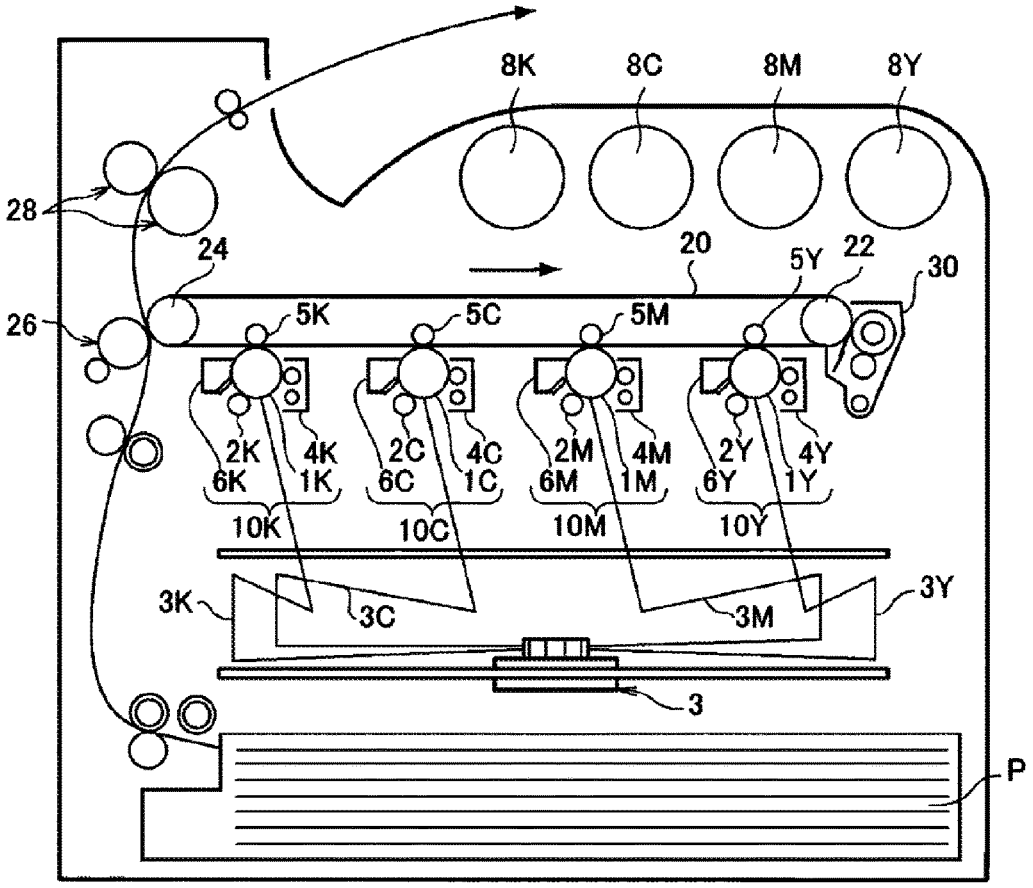
FIG. 1 is a schematic configuration diagram showing an image forming apparatus according to the exemplary embodiment.

Hereinafter, the exemplary embodiments which are an example of the invention will be described in detail.

Electrostatic Charge Image Developing Toner

In an electrostatic charge image developing toner (hereinafter, also simply referred to as a "toner") according to the exemplary embodiment, when toner particles are subjected to a measurement by differential scanning calorimetry (DSC) before and after being stored at a temperature of 50° C. and a humidity of 90% RH for 24 hours, a relationship between an onset temperature T1 (° C.) of an endothermic peak having the lowest peak temperature in a first heating step with respect to the toner particles before storing, and an onset temperature T2 (° C.) of an endothermic peak having the lowest peak temperature in a first heating step with respect to the toner particles after storing satisfies Expression (1): $2<T2-T1<10$.

With the configuration described above, the toner according to the exemplary embodiment prevents occurrence of image deletion which occurs when images are continuously formed at a high processing speed (for example, feeding speed of recording media equal to or higher than 300 mm/sec) in a high temperature and high humidity environment (for example, in an environment of a temperature of 32° C. and humidity of 80% RH). The toner prevents occurrence of the offset (phenomenon in which apart of a fixed image is transferred to a fixing member) which occurs when an image is initially formed on a thick recording medium having great surface ruggedness (for example, rough paper having a thickness of 90 μm to 200 μm) in a low temperature and low humidity environment (for example, in an environment of a temperature of 15° C. and a humidity of 10% RH). A reason therefor is assumed as follows.

In recent years, in regards to a demand for energy saving, a technology of improving low temperature fixing properties of a toner, in order to reduce power consumption when fixing a toner image has been known. As one technology, a toner including an amorphous resin and a crystalline resin in toner particles has been known. Meanwhile, from a viewpoint of ensuring heat resistance, a technology of forming a structure (sea-island structure) in which an amorphous resin and a crystalline resin are suitably phase-separated in toner particles has been known.

However, in a degree of "phase separation between an amorphous resin and a crystalline resin" of the related art, the amount of the crystalline resin compatible with the amorphous resin is large, and accordingly, heat resistance of the toner is not sufficient, and image deletion may occur, when images are continuously formed at a high processing speed (for example, feeding speed of recording media equal to or higher than 300 mm/sec) in a high temperature and high humidity environment (for example, in an environment of a temperature of 32° C. and a humidity of 80% RH).

Specifically, the crystalline resin (particularly, polyester resin) has high absorbency and is easily receives a plasticizing effect of water. Particularly, in a compatible portion in which the amorphous resin and the crystalline resin are compatible with each other, a glass transition temperature Tg of the resin decreases, and when water acts in the temperature-decreased portion, heat resistance may be deteriorated. Accordingly, when images are continuously formed at a high processing speed in the high temperature and high humidity environment, the temperature in a device is excessively increased (for example, increased to 50° C.), while having high humidity, and thus, aggregation of toner may occur in a developing unit. The image deletion may occur due to the aggregated toner.

Meanwhile, when the amount of the crystalline resin compatible with the amorphous resin is excessively small (that is, phase separation between the amorphous resin and the crystalline resin is excessively performed), the offset may occur, when an image is initially formed on a thick recording medium having great surface ruggedness (for example, rough paper having a thickness of 90 μm to 200 μm) in a low temperature and low humidity environment (for example, in an environment of a temperature of 15° C. and a humidity of 10% RH).

Specifically, when the amount of the crystalline resin compatible with the amorphous resin is excessively small (that is, phase separation between the amorphous resin and the crystalline resin is excessively performed), a degree of plasticization of the amorphous resin due to compatibility of the crystalline resin is decreased, and the toner is hardly melted. Meanwhile, when an image is initially formed on a recording medium (that is, when the printing of a first sheet is performed) in a low temperature and low humidity environment such as in the morning during the winter, a temperature of a fixing unit (fixing member thereof) may not be sufficiently increased, and heat is hardly applied to a toner image at the time of fixing. In addition, when an image is formed on a thick recording medium having great surface ruggedness, heat may be hardly transferred to a toner image on a bottom portion of a recess of a recording medium. Thus, the offset may occur. Particularly, when an image having a large toner applied amount is formed, the offset may occur in a rear end portion of a recording medium in a transportation direction.

Therefore, in the toner according to the exemplary embodiment, the ranges of the phase-separated amount of the crystalline resin from the amorphous resin and the amount of the crystalline resin compatible therewith, in the toner particles, are suitably controlled. That is, when toner particles are stored at a temperature of 50° C. and a humidity of 90% RH for 24 hours, a relationship between an onset temperature T1 (° C.) of an endothermic peak having the lowest peak temperature in a first heating step which is measured by differential scanning calorimeter (DSC) regarding the toner particles before storing, and an onset temperature T2 (° C.) of an endothermic peak having the lowest peak temperature in a first heating step which is measured by differential scanning calorimeter (DSC) regarding the toner particles after storing satisfies Expression (1): $2<T2-T1<10$.

Here, when the measurement of the toner particles is performed by differential scanning calorimeter (DSC), the onset temperature of the endothermic peak having the lowest peak temperature in the first heating step becomes an index showing a degree of compatibility (incompatibility) between the amorphous resin and the crystalline resin.

Specifically, a low onset temperature of the endothermic peak having the lowest peak temperature in the first heating step means that the amount (compatible portion) of the crystalline resin compatible with the amorphous resin is large and the phase-separated amount of the crystalline resin is small. The high onset temperature of the endothermic peak having the lowest peak temperature in the first heating step means that the amount (compatible portion) of the crystalline resin compatible with the amorphous resin is small and the phase-separated amount of the crystalline resin is large.

Meanwhile, when the toner particles are stored at a temperature of 50° C. and a humidity of 90% RH for 24 hours, phase separation between the amorphous resin and the crystalline resin proceeds in the toner particles, and the amount of the crystalline resin compatible with the amorphous resin becomes close to zero.

That is, satisfying Expression (1): $2<T2-T1<10$ with a relationship in which an onset temperature T1 (° C.) of an endothermic peak having the lowest peak temperature in a first heating step which is measured by differential scanning calorimeter (DSC) regarding the toner particles before storing, and an onset temperature T2 (° C.) of an endothermic peak having the lowest peak temperature in a first heating step which is measured by differential scanning calorimeter (DSC) regarding the toner particles after storing means that the phase-separated amount of the crystalline resin from the amorphous resin in the toner particles is larger than the amount (compatible portion) of the crystalline resin compatible therewith in a suitable range.

When a value of "T2−T1" in Expression (1) is set to be smaller than 10 to decrease the amount (compatible portion) of the crystalline resin compatible with the amorphous resin (that is, to prevent an excessive compatible state between the amorphous resin and the crystalline resin), the size of the "compatible portion in which the amorphous resin and the crystalline resin are compatible with each other" which causes a decrease in the glass transition temperature Tg of the resin is decreased. Accordingly, heat resistance of the toner is increased, and even when images are continuously formed at a high processing speed in the high temperature and high humidity environment, the toner aggregation is prevented, and occurrence of image deletion is prevented.

Meanwhile, when a value of "T2−T1" in Expression (1) is set to be greater than 2 to prevent an excessive decrease in the amount (compatible portion) of the crystalline resin compatible with the amorphous resin (that is, to prevent excessive phase separation between the amorphous resin and the crystalline resin), a deterioration of meltability of the toner is prevented, and therefore, occurrence of the offset is prevented, even when an image is initially formed on a thick recording medium having great surface ruggedness in the low temperature and low humidity environment.

As described above, in the toner according to the exemplary embodiment, it is assumed that occurrence of image deletion which occurs when images are continuously formed at a high processing speed in the high temperature and high humidity environment is prevented. In addition, it is assumed that occurrence of the offset which occurs when an image is initially formed on a thick recording medium having great surface ruggedness in the low temperature and low humidity environment is prevented.

As a recording medium having great surface ruggedness, a recording medium having a Bekk smoothness equal to or less than 50 seconds (for example, rough paper) is used. The Bekk smoothness is a value measured based on a method of JIS P 8119 (1998).

In the toner according to the exemplary embodiment, Expression (1): $2<T2-T1<10$ is satisfied, but, from a viewpoint of preventing occurrence of image deletion and offset, Expression (12): $3\leq T2-T1\leq 8$ is preferably satisfied.

The value of "T2−T1" may be adjusted, for example, depending on the amount of a nucleating agent with respect to the crystalline resin or a molecular weight of the crystalline resin.

Here, the toner particles are stored in an environment of a temperature of 50° C. and a humidity of 90% RH for 24 hours. A measurement method of the glass transition temperature Tg of the amorphous resin is as follows.

Meanwhile, the measurement of the onset temperature of the endothermic peak having the lowest peak temperature in the first heating step measured by a differential scanning calorimeter is performed based on ASTMD 3418-8.

Specifically, Specifically, 10 mg of the toner particles (or toner particles to which the external additive is externally added) which is a measurement target is set in a differential scanning calorimeter (manufactured by Shimadzu Corporation: DSC-60A) including an automatic connection processing system, and heated from room temperature (25° C.) to 150° C. at a rate of temperature rise of 10° C./min, and heating spectra (DSC curve) in the first heating process are obtained.

The endothermic peak having the lowest peak temperature is specified from the obtained heating spectra (DSC curve). Here, the endothermic peak indicates that a half value width is within 15° C.

Figure 3:
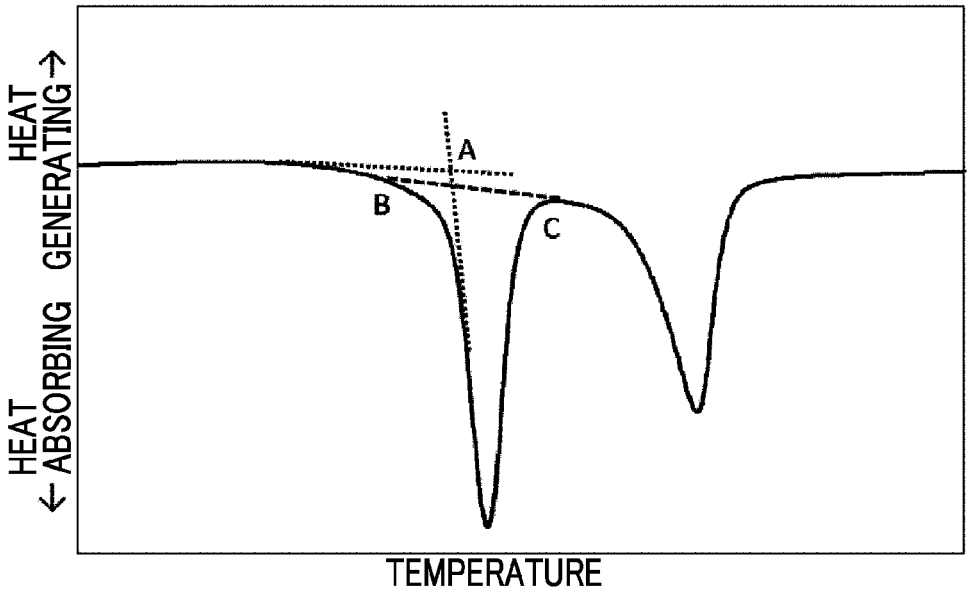
FIG. 3 is a schematic diagram for explaining an onset temperature of an endothermic peak in measurement performed by a differential scanning calorimeter.

The onset temperature of the specified endothermic peak is measured. Here, the onset temperature is a temperature shown as an intersection point A between a linear line obtained by extending a base line of a low temperature side of the specified endothermic peak to a high temperature side in the heating spectra (DSC curve), and a tangent obtained by drawn at a point of maximum slope (inflection point) of a curve showing a change in heat quantity from the endothermic initiation to the endothermic peak apex at the time of a temperature increase regarding the specified endothermic peak (see FIG. 3).

In a case of the toner particles to which an external additive is externally added, the toner particles to which an external additive is externally added are set as a heating target and a measurement target of the onset temperature.

In the toner according to the exemplary embodiment, from a viewpoint of obtaining an image having high intensity, the measurement of the toner particles before storing is performed by a differential scanning calorimeter (DSC), and a relationship between an endothermic amount S1 (J/g) derived from the crystalline resin in a first heating process and an endothermic amount S2 (J/g) derived from the crystalline resin in a second heating step preferably satisfies Expression (2): $S2/S1<0.3$.

Here, the endothermic amount derived from the crystalline resin of the toner particles measured by a differential scanning calorimeter (DSC) is an endothermic amount based on the endothermic peak of the crystalline resin which is phase-separated from the amorphous resin. That is, a small endothermic amount derived from the crystalline resin means that the amount (compatible portion) of the crystalline resin compatible with the amorphous resin is large and the phase-separated amount of the crystalline resin is small. The large endothermic amount derived from the crystalline resin means that the amount (compatible portion) of the crystalline resin compatible with the amorphous resin is small and the phase-separated amount of the crystalline resin is large.

The endothermic amount S1 derived from the crystalline resin in the first heating process indicates a state in which the amorphous resin and the crystalline resin of the toner before being fixed are compatible with each other, and the endothermic amount S2 derived from the crystalline resin in the second heating process indicates a state in which the amorphous resin and the crystalline resin of a fixed image after the fixing are compatible with each other.

Accordingly, satisfying Expression (2): $S2/S1<0.3$ indicates a state where the "amount (compatible portion) of the crystalline resin compatible with the amorphous resin" is decreased (that is, a state where excessive compatible state between the amorphous resin and the crystalline resin is prevented) in the toner before the fixing, and indicates a state where the "amount (compatible portion) of the crystalline resin compatible with the amorphous resin" is large (that is, a state where compatible state between the amorphous resin and the crystalline resin has proceeded) in a fixed image after the fixing.

Therefore, when Expression (2): $S2/S1<0.3$ is satisfied, interaction between the amorphous resin and the crystalline resin occurs at the time of the fixing, the amorphous resin and the crystalline resin may be compatible with each other nearly uniformly in a fixed image, and an image having high intensity (particularly, image having high anti-crease performance) is obtained.

The adjustment of the value of "S2/S1" in Expression (2) is performed by a method of adjusting a cooling speed at the time of manufacturing the toner particles, for example.

The measurement of the endothermic amount derived from the crystalline resin of the toner particles measured by differential scanning calorimeter is performed based on ASTMD 3418-8.

Specifically, Specifically, 10 mg of the toner particles (or toner particles to which the external additive is externally added) which is a measurement target is set in a differential scanning calorimeter (manufactured by Shimadzu Corporation: DSC-60A) including an automatic connection processing system, and heated from room temperature (25° C.) to 150° C. at a rate of temperature rise of 10° C./min, and heating spectra (DSC curve) in the first heating process are obtained. After that, the temperature is decreased to room temperature (25° C.) at a rate of temperature decrease of 10° C./min.

Then, in the same manner as described above, the temperature is increased from room temperature (25° C.) to 150° C. at a rate of temperature rise of 10° C./min, and heating spectra (DSC curve) in the second heating process are obtained. After that, the temperature is decreased to room temperature (25° C.) at a rate of temperature decrease of 10° C./min.

An endothermic peak derived from the crystalline resin is specified from the obtained heating spectra (DSC curves) in the first and second heating processes. The endothermic peak derived from the crystalline resin is specified based on the endothermic peak obtained from the DSC curve of the crystalline resin (simple substance) performed based on ASTMD 3418-8. The area of the endothermic peak derived from the crystalline resin is calculated as the endothermic amount. The area of the endothermic peak is calculated as an area of a falling portion from the base line (portion surrounded by B and C of FIG. 3). Here, the endothermic peak indicates that a half value width is within 15° C.

By doing so, the endothermic amounts S1 and S2 derived from the crystalline resin are respectively measured.

In a case of the toner particles to which an external additive is externally added, the toner particles to which an external additive is externally added are set as a measurement target of the endothermic amount of the crystalline resin.

Hereinafter, the toner according to the exemplary embodiment will be described in detail.

The toner according to the exemplary embodiment, for example, includes toner particles and an external additive.

Toner Particles

The toner particles include a binder resin. The toner particles may further include a colorant, a release agent, and other additives, if necessary.

Binder Resin

Examples of the binder resin include an amorphous resin and a crystalline resin.

A weight ratio between the amorphous resin and the crystalline resin (amorphous resin/crystalline resin) is preferably 70/30 to 93/7 and more preferably 50/50 to 97/3.

The content of the entire binder resin is preferably 40% by weight to 95% by weight, more preferably 50% by weight to 90% by weight, and even more preferably 60% by weight to 85% by weight with respect to the content of the toner particles.

Here, "crystallinity" of the resin indicates that a clear endothermic peak is provided without a stepwise change in the endothermic amount, in the differential scanning calorimetry (DSC) based on ASTMD 3418-8, and specifically indicates that a half value width of the endothermic peak measured at a rate of temperature rise of 10 (° C./min) is within 10° C.

Meanwhile, "non-crystallinity" of the resin indicates that a half value width exceeds 10° C., a stepwise change in the endothermic amount is shown, or a clear endothermic peak is not recognized.

The amorphous resin will be described.

As the amorphous resin, well-known amorphous resins such as an amorphous polyester resin, an amorphous vinyl resin (for example, a styrene acrylic resin or the like), an epoxy resin, a polycarbonate resin, and a polyurethane resin are used, for example. Among these, an amorphous polyester resin and an amorphous vinyl resin (particularly, a styrene acrylic resin) are preferable and an amorphous polyester resin is more preferable, from viewpoints of low temperature fixing properties and chargeability of the toner.

Examples of the amorphous polyester resin include condensation polymers of polyvalent carboxylic acids and polyols. A commercially available product or a synthesized product may be used as the amorphous polyester resin.

Examples of the polyvalent carboxylic acid include aliphatic dicarboxylic acids (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalenedicarboxylic acid), anhydrides thereof, or lower alkyl esters thereof (the alkyl group having from 1 to 5 carbon atoms, for example). Among these substances, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used singly or in combination of two or more types thereof.

Examples of the polyol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more types thereof.

A well-known preparing method is applied to prepare the amorphous polyester resin. Examples thereof include a method of conducting a reaction at a polymerization temperature of 180° C. to 230° C., if necessary, under reduced pressure in the reaction system, while removing water or an alcohol generated during condensation.

In the case in which monomers of the raw materials are not dissolved or compatibilized at a reaction temperature, a high-boiling-point solvent may be added as a solubilizing agent to dissolve the monomers. In this case, a polycondensation reaction is conducted while distilling away the solubilizing agent. In the case in which a monomer having poor compatibility is used, the monomer having poor compatibility and an acid or an alcohol to be polycondensed with the monomer may be previously condensed and then polycondensed with the main component.

Here, as the amorphous polyester resin, a modified amorphous polyester resin is also used, in addition to the unmodified amorphous polyester resin described above. The modified amorphous polyester resin is an amorphous polyester resin in which a bonding group other than an ester bond is present, and an amorphous polyester resin in which a resin component other than the amorphous polyester resin is bonded by covalent bonding or ionic bonding. As the modified amorphous polyester resin, usable is, for example, a resin including a terminal modified by allowing a reaction between an amorphous polyester resin which a functional group such as an isocyanate group capable of reacting with an acid group or a hydroxyl group is introduced to a terminal thereof, and an active hydrogen compound.

As the modified amorphous polyester resin, a urea-modified amorphous polyester resin (hereinafter, also simply referred to as an "urea-modified polyester resin") is preferable.

As the urea-modified polyester resin, a urea-modified polyester resin obtained by a reaction (at least one reaction of a crosslinking reaction and an extension reaction) between an amorphous polyester resin including an isocyanate group (amorphous polyester prepolymer) and an amine compound may be used. The urea-modified polyester resin may include a urea bond and a urethane bond.

As an amorphous polyester prepolymer including an isocyanate group, an amorphous polyester prepolymer obtained by allowing a reaction of a polyvalent isocyanate compound with respect to an amorphous polyester resin which is a polycondensate of polyvalent carboxylic acid and polyol and includes active hydrogen is used. Examples of a group including active hydrogen included in the amorphous polyester resin include a hydroxyl group (alcoholic hydroxyl group and phenolic hydroxyl group), an amino group, a carboxyl group, and a mercapto group, and an alcoholic hydroxyl group is preferable.

As polyvalent carboxylic acid and polyol of the amorphous polyester prepolymer including an isocyanate group, the compounds same as polyvalent carboxylic acid and polyol described in the section of the amorphous polyester resin are used.

Examples of a polyvalent isocyanate compound include aliphatic polyisocyanate (tetramethylene diisocyanate, hexamethylene diisocyanate, or 2,6-diisocyanato methyl caproate); alicyclic polyisocyanate (isophorone diisocyanate or cyclohexylmethane diisocyanate); aromatic diisocyanate (tolylene diisocyanate or diphenylmethane diisocyanate); aromatic aliphatic diisocyanate ($\alpha,\alpha,\alpha',\alpha'$-tetramethylxylylene diisocyanate); isocyanurates; and a component obtained by blocking the polyisocyanate by a blocking agent such as a phenol derivative, oxime, or caprolactam.

The polyvalent isocyanate compounds may be used singly or in combination of two or more kinds thereof.

A ratio of the polyvalent isocyanate compound is preferably from 1/1 to 5/1, more preferably from 1.2/1 to 4/1, and even more preferably from 1.5/1 to 2.5/1, as an equivalent ratio [NCO]/[OH] of an isocyanate group [NCO] and a hydroxyl group of an amorphous polyester prepolymer including a hydroxyl group [OH].

In the amorphous polyester prepolymer including an isocyanate group, the content of a component derived from the polyvalent isocyanate compound is preferably from 0.5% by weight to 40% by weight, more preferably from 1% by weight to 30% by weight, and even more preferably from 2% by weight to 20% by weight, with respect to the content of the entire amorphous polyester prepolymer including an isocyanate group.

The number of isocyanate groups contained per 1 molecule of the amorphous polyester prepolymer including an isocyanate group is preferably averagely equal to or greater than 1, more preferably averagely from 1.5 to 3, and even more preferably averagely from 1.8 to 2.5.

Examples of the amine compound to be reacted with the amorphous polyester prepolymer including an isocyanate group include diamine, tri- or higher valent polyamine, amino alcohol, amino mercaptan, amino acid, and a compound obtained by blocking these amino groups.

Examples of diamine include aromatic diamine (phenylene diamine, diethyl toluene diamine, or 4,4'diaminodiphenylmethane); alicyclic diamine (4,4'-diamino-3,3'dimethyl dicyclohexyl methane, diamine cyclohexane, or isophorone diamine); and aliphatic diamine (ethylenediamine, tetramethylenediamine, or hexamethylenediamine).

Examples of tri- or higher valent polyamine include diethylenetriamine and triethylenetetramine.

Examples of amino alcohol include ethanolamine and hydroxyethyl aniline.

Examples of amino mercaptan include aminoethylmercaptan and aminopropyl mercaptan.

Examples of amino acid include aminopropionic acid and aminocaproic acid.

Examples of a compound obtained by blocking these amino groups include a ketimine compound and an oxazoline compound obtained from an amine compound such as diamine, tri- or higher valent polyamine, amino alcohol, amino mercaptan, or amino acid and a ketone compound (acetone, methyl ethyl ketone, or methyl isobutyl ketone).

Among these amino compounds, a ketimine compound is preferable.

The amine compounds may be used singly or in combination of two or more kinds thereof.

The urea-modified polyester resin may be a resin in which the molecular weight after the reaction is adjusted by adjusting a reaction between the amorphous polyester resin including an isocyanate group (amorphous polyester prepolymer) and an amine compound (at least one reaction of the crosslinking reaction and the extension reaction), using a stopper which stops at least one reaction of the crosslinking reaction and the extension reaction (hereinafter, also referred to as a "crosslinking/extension reaction stopper").

Examples of the crosslinking/extension reaction stopper include monoamine (diethylamine, dibutylamine, butylamine, or laurylamine) and a compound obtained by blocking those (ketimine compound).

A ratio of the amine compound is preferably from 1/2 to 2/1, more preferably from 1/1.5 to 1.5/1, and even more preferably from 1/1.2 to 1.2/1, as an equivalent ratio [NCO]/[NHx] of an isocyanate group [NCO] of the amorphous polyester prepolymer including an isocyanate group and an amino group [NHx] of amines.

As the urea-modified polyester resin, a urea-modified polyester resin obtained by a reaction (at least one reaction of a crosslinking reaction and an extension reaction) between a polyester resin including an isocyanate group (hereinafter, referred to as a "polyester prepolymer") and an amine compound may be used. The urea-modified polyester resin may include a urea bond and a urethane bond.

As a polyester prepolymer, a reactant between polyester including a group including active hydrogen and a polyvalent isocyanate compound is used. Examples of a group including active hydrogen include a hydroxyl group (alcoholic hydroxyl group and phenolic hydroxyl group), an amino group, a carboxyl group, and a mercapto group, and an alcoholic hydroxyl group is preferable. Examples of a polyvalent isocyanate compound include aliphatic polyisocyanate (tetramethylene diisocyanate, hexamethylene diisocyanate, or 2,6-diisocyanato methyl caproate); alicyclic polyisocyanate (isophorone diisocyanate or cyclohexylmethane diisocyanate); aromatic diisocyanate (tolylene diisocyanate or diphenylmethane diisocyanate); aromatic aliphatic diisocyanate ($\alpha,\alpha,\alpha',\alpha'$-tetramethylxylylene diisocyanate); isocyanurates; and a compound obtained by blocking the polyisocyanate by a blocking agent such as a phenol derivative, oxime, or caprolactam. The polyvalent isocyanate compounds may be used singly or in combination of two or more kinds thereof.

The content of a component derived from the polyvalent isocyanate compound of the polyester prepolymer is preferably 0.5% by weight to 40% by weight, more preferably 1% by weight to 30% by weight, and even more preferably 2% by weight to 20% by weight, with respect to the content of the entire polyester prepolymer. The average number of isocyanate groups contained per 1 molecule of the polyester prepolymer is preferably equal to or greater than 1, more preferably 1.5 to 3, and even more preferably 1.8 to 2.5.

Examples of the amine compound to be reacted with the polyester prepolymer include diamine, tri- or higher valent polyamine, amino alcohol, amino mercaptan, amino acid, a compound obtained by blocking an amino group of these amino compounds.

Examples of diamine include aromatic diamine (phenylene diamine, diethyl toluene diamine, or 4,4'diaminodiphenylmethane); alicyclic diamine (4,4'-diamino-3,3'dimethyl dicyclohexyl methane, diamine cyclohexane, or isophorone diamine); and aliphatic diamine (ethylenediamine, tetramethylenediamine, or hexamethylenediamine). Examples of tri- or higher valent polyamine include diethylenetriamine and triethylenetetramine. Examples of amino alcohol include ethanolamine and hydroxyethyl aniline. Examples of amino mercaptan include aminoethyl mercaptan and aminopropyl mercaptan. Examples of amino acid include aminopropionic acid and aminocaproic acid.

Examples of a compound obtained by blocking the amine compound include a ketimine compound and an oxazoline compound derived from the amine compound and ketone compound (acetone, methyl ethyl ketone, or methyl isobutyl ketone).

As the amine compound, a ketimine compound is preferable. The amine compounds may be used singly or in combination of two or more kinds thereof.

The urea-modified polyester resin may be a resin in which the molecular weight after the reaction is adjusted by adjusting a reaction between the polyester prepolymer and an amine compound using a stopper which stops at least one reaction of the crosslinking reaction and the extension reaction (hereinafter, also referred to as a "crosslinking/extension reaction stopper"). Examples of the crosslinking/extension reaction stopper include monoamine (diethylamine, dibutylamine, butylamine, or laurylamine) and a component obtained by blocking the amino group of monoamine (ketimine compound).

The characteristics of the amorphous resin will be described.

The glass transition temperature (Tg) of the amorphous resin is preferably 50° C. to 80° C., and more preferably 50° C. to 65° C.

The glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The weight average molecular weight (Mw) of the amorphous resin is preferably 5,000 to 1,000,000 and more preferably 7,000 to 500,000.

The number average molecular weight (Mn) of the amorphous resin is preferably 2,000 to 100,000.

The molecular weight distribution Mw/Mn of the amorphous resin is preferably 1.5 to 100 and more preferably 2 to 60.

The weight average molecular weight and the number average molecular weight are measured by gel permeation chromatography (GPC). The molecular weight measurement by GPC is performed by using GPC•HLC-8120 GPC manufactured by Tosoh Corporation as a measuring device, TSKGEL SUPERHM-M (15 cm) manufactured by Tosoh Corporation, as a column, and a THF solvent. The weight average molecular weight and the number average molecular weight are calculated using a calibration curve of molecular weight obtained with a monodisperse polystyrene standard sample from the measurement results obtained from the measurement.

The crystalline resin will be described.

As the crystalline resin, well-known crystalline resins such as a crystalline polyester resin and a crystalline vinyl resin (for example, a polyalkylene resin or a long-chain alkyl (meth)acrylate resin) are used. Among these, a crystalline polyester resin is preferable from viewpoints of mechanical toughness and low temperature fixing properties of the toner.

Examples of the crystalline polyester resin include condensation polymers of polyvalent carboxylic acids and polyols. A commercially available product or a synthesized product may be used as the crystalline polyester resin.

Here, since a crystal structure is easily formed with the crystalline polyester resin, a condensation polymer using a polymerizable monomer including a straight aliphatic group is preferable than a polymerizable monomer including an aromatic group.

Examples of the polyvalent carboxylic acid include aliphatic dicarboxylic acids (e.g., oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetra decane dicarboxylic acid, and 1,18-octadecane dicarboxylic acid), aromatic dicarboxylic acids (e.g., phthalic acid, isophthalic acid, terephthalic acid, dibasic acid of naphthalene-2,6-dicarboxylic acid), anhydrides thereof, or lower alkyl esters (having, for example, from 1 to 5 carbon atoms) thereof.

As the polyvalent carboxylic acid, a tri- or higher-valent carboxylic acid employing a crosslinked structure or a branched structure may be used in combination with a dicarboxylic acid. Examples of the trivalent carboxylic acid include aromatic carboxylic acid (e.g., 1,2,3-benzenetricarboxylic acid, 1,2,4-benzenetricarboxylic acid, and 1,2,4-naphthalene tricarboxylic acid), anhydrides thereof, or lower alkyl esters (having, for example, from 1 to 5 carbon atoms) thereof.

As the polyvalent carboxylic acid, a dicarboxylic acid having a sulfonic acid group and a dicarboxylic acid having an ethylenic double bond may be used in combination with the dicarboxylic acids described above.

The polyvalent carboxylic acids may be used singly or in combination of two or more kinds thereof.

Examples of the polyol include aliphatic diols (e.g., linear aliphatic diol having 7 to 20 carbon atoms of main chain part). Examples of aliphatic diols include ethylene glycol, 1,3-propanediol, 1,4-butanediol, 1,5-pentanediol, 1,6-hexanediol, 1,7-heptane diol, 1,8-octanediol, 1,9-nonanediol, 1,10-decanediol, 1,11-undecanediol, 1,12-dodecane diol, 1,13-tri-decanediol, 1,14-tetradecanediol, 1,18-octadecanediol, and 1,14-eicosanedecanediol. Among these, 1,8-octanediol, 1,9-nonanediol, and 1,10-decanediol are preferable as aliphatic diols.

As the polyol, a tri- or higher-valent alcohol employing a crosslinked structure or a branched structure may be used in combination with a diol. Examples of the tri- or higher-valent polyol include glycerin, trimethylolethane, trimethylolpropane, and pentaerythritol.

The polyols may be used singly or in combination of two or more kinds thereof.

Here, in the polyol, the content of aliphatic diol may be suitably 80 mol % or more and is more preferably 90 mol % or more.

A well-known preparing method is applied to prepare the crystalline polyester resin, in the same manner as in the amorphous polyester resin.

The characteristics of the crystalline resin will be described.

A melting temperature of the crystalline resin is preferably 50° C. to 100° C., more preferably 55° C. to 90° C., and even more preferably 60° C. to 85° C.

As the melting temperature of the crystalline resin increases, the onset temperature T2 of the endothermic peak also increases. Accordingly, the value of "T2−T1" in Expression (1) may be controlled depending on the melting temperature of the crystalline resin.

The melting temperature is obtained from "melting peak temperature" described in the method of obtaining a melting temperature in JIS K7121-1987 "Testing Methods for Transition Temperatures of Plastics", from a DSC curve obtained by differential scanning calorimetry (DSC).

A weight average molecular weight (Mw) of the crystalline resin is preferably 6,000 to 35,000.

As the weight average molecular weight (Mw) of the crystalline resin increases, the onset temperature T2 of the endothermic peak also increases. Accordingly, the value of "T2−T1" in Expression (1) may be controlled depending on the weight average molecular weight of the crystalline resin.

Here, a suitable combination of the amorphous resin and the crystalline resin will be described.

A combination of the amorphous resin and the crystalline resin is selected by changing structures of the crystalline polyester resin and the amorphous resin and controlling a blending ratio between both resins or dispersion structures at the time of manufacturing, from viewpoints of satisfying Expression (1): $2<T2-T1<10$ and preventing occurrence of image deletion and the offset.

The structure changing is performed, for example, by changing monomer units configuring both resins. In this case, a solubility parameter (SP value) is calculated by Fedors method (Polym. Eng. Sci., 14, 147 (1974)). When the SP values of both resins are set to be close to each other, compatibility is increased and a value of ΔH2/ΔH1 may be decreased.

Specifically, for example, when bisphenol A ethylene oxide adduct as an alcohol component of polyester is changed to bisphenol A propylene oxide adduct, the SP value of the polyester resin obtained may be decreased. When dicarboxylic used as an acid component is changed from aliphatic dicarboxylic acid such as sebacic acid to aromatic dicarboxylic acid such as terephthalic acid, the SP value may be increased.

The SP value of the resin may also be measured by measuring solubility with respect to a well-known solvent. However, the actual phenomenon that both resins are compatible with each other is also related to an interaction between both resins, and accordingly, the compatibility is not only determined with the SP value.

Here, a difference (ASP value) between the SP value of the crystalline resin and the SP value of the amorphous resin is preferably in a range of 0.2 to 1.3 and more preferably in a range of 0.5 to 1.1.

Colorant

Examples of the colorant include various pigments such as carbon black, chrome yellow, Hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, Rhodamine B Lake, Lake Red C, pigment red, rose bengal, aniline blue, ultramarine blue, calco oil blue, methylene blue chloride, phthalocyanine blue, pigment blue, phthalocyanine green, and malachite green oxalate; and various dyes such as acridine dyes, xanthene dyes, azo dyes, benzoquinone dyes, azine dyes, anthraquinone dyes, thioindigo dyes, dioxadine dyes, thiazine dyes, azomethine dyes, indigo dyes, phthalocyanine dyes, aniline black dyes, polymethine dyes, triphenylmethane dyes, diphenylmethane dyes, and thiazole dyes.

The colorants may be used singly or in combination of two or more types thereof.

As the colorant, the surface-treated colorant may be used, if necessary. The colorant may be used in combination with a dispersing agent. Plural colorants may be used in combination.

The content of the colorant is, for example, preferably 1% by weight to 30% by weight, more preferably 3% by weight to 15% by weight with respect to a total amount of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably 50° C. to 110° C. and more preferably 60° C. to 100° C.

The melting temperature is obtained from "melting peak temperature" described in the method of obtaining a melting temperature in JIS K 7121-1987 "Testing methods for transition temperatures of plastics", from a DSC curve obtained by differential scanning calorimetry (DSC).

The content of the release agent is, for example, preferably 1% by weight to 20% by weight, and more preferably 5% by weight to 15% by weight with respect to the total amount of the toner particles.

Other Additives

Examples of other additives include well-known additives such as a magnetic material, a charge-controlling agent, and an inorganic particle. The toner particles include these additives as internal additives.

Characteristics of Toner Particles

The toner particles may be toner particles having a single-layer structure, or toner particles having a so-called core/shell structure composed of a core (core particle) and a coating layer (shell layer) coated on the core.

Here, the toner particles having a core/shell structure may be configured with, for example, a core including a binder resin, and if necessary, other additives such as a colorant and a release agent, and a coating layer including a binder resin.

The volume average particle diameter (D50v) of the toner particles is preferably 2 μm to 10 μm, and more preferably 4 μm to 8 μm.

Various average particle diameters and various particle size distribution indices of the toner particles are measured by using a COULTER MULTISIZER II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to from 100 ml to 150 ml of the electrolyte.

The electrolyte in which the sample is suspended is subjected to a dispersion treatment using an ultrasonic disperser for 1 minute, and a particle size distribution of particles having a particle diameter of from 2 μm to 60 μm is measured by a COULTER MULTISIZER II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume average particle diameter D16v and a number average particle diameter D16p, while the particle diameter when the cumulative percentage becomes 50% is defined as that corresponding to a volume average particle diameter D50v and a number average particle diameter D50p. Furthermore, the particle diameter when the cumulative percentage becomes 84% is defined as that corresponding to a volume average particle diameter D84v and a number average particle diameter D84p.

Using these, a volume average particle size distribution index (GSDv) is calculated as $(D84v/D16v)^{1/2}$, while a number average particle size distribution index (GSDp) is calculated as $(D84p/D16p)^{1/2}$.

An average circularity of the toner particles is preferably 0.94 to 1.00 and more preferably 0.95 to 0.98.

The average circularity of the toner particles is determined by an expression of (perimeter of equivalent circle diameter)/(perimeter) [(perimeter of a circle having the same projected area as that of a particle image)/(perimeter of particle projection image)]. Specifically, the average circularity thereof is a value measured using the following method.

First, the toner particles which is a measurement target are sucked and collected, a flat flow is formed, stroboscopic light emission is instantly performed to obtain a particle image as a still image, and the average circularity is determined using a flow-type particle image analysis device (FPIA-2100 manufactured by Sysmex Corporation) which performs image analysis of the particle image. 3,500 particles are sampled when determining the average circularity.

In a case where the toner includes an external additive, the toner (developer) which is a measurement target is dispersed in water including a surfactant, and then, the ultrasonic treatment is performed to obtain toner particles from which the external additive is removed.

External Additives

As the other external additives, inorganic particles are used, for example. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O$—$(TiO_2)n$, $Al_2O_3.2SiO_2$, $CaCO_3$, $MgCO_3$, $BaSO_4$, and $MgSO_4$.

The surfaces of the inorganic particles as the external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used singly or in combination of two or more kinds thereof.

Generally, the amount of the hydrophobizing agent is, for example, 1 part by weight to 10 parts by weight with respect to 100 parts by weight of the inorganic particles.

Examples of the external additives also include resin particles (resin particles such as polystyrene, polymethyl methacrylate (PMMA), and melamine resin) and a cleaning aid (for example, a metal salt of higher fatty acid represented by zinc stearate, and fluorine polymer particles).

The amount of the external additives externally added is, for example, preferably 0.01% by weight to 5% by weight, and more preferably 0.01% by weight to 2.0% by weight with respect to the amount of the toner particles.

Preparing Method of Toner

Next, a preparing method of the toner according to the exemplary embodiment will be described.

The toner according to the exemplary embodiment is obtained by externally adding an external additive to toner particles, after preparing the toner particles.

The toner particles may be prepared using any of a dry preparing method (e.g., kneading and pulverizing method) and a wet preparing method (e.g., aggregation and coalescence method, suspension and polymerization method, and dissolution and suspension method). The toner particle preparing method is not particularly limited to these preparing methods, and a known preparing method is employed.

First, a toner particle preparing method using an aggregation and coalescence method will be described.

The toner particles are manufactured through the processes of: preparing a resin particle dispersion in which resin particles as a binder resin are dispersed (resin particle dispersion preparation process); aggregating the resin particles (if necessary, other particles) in the resin particle dispersion (if necessary, in the dispersion after mixing with other particle dispersions) to form aggregated particles (aggregated particle forming process); and heating the aggregated particle dispersion in which the aggregated particles are dispersed, to aggregate and coalesce the aggregated particles, thereby forming toner particles (aggregation and coalescence process).

Here, as the resin particle dispersion, an amorphous resin particle dispersion in which amorphous resin particles are dispersed, and a crystalline resin particle dispersion in which crystalline resin particles are dispersed are applied. As the resin particle dispersion, an amorphous resin particle dispersion in which resin particles including the amorphous resin and the crystalline resin are dispersed may also be applied.

Hereinafter, the processes will be described below in detail.

In the following description, a method of obtaining toner particles containing a colorant and a release agent will be described, but a colorant and a release agent is used, if necessary. Other additives may be used, in addition to a colorant and a release agent.

Resin Particle Dispersion Preparation Process

First, for example, a colorant particle dispersion in which colorant particles are dispersed and a release agent particle dispersion in which release agent particles are dispersed are prepared together with a resin particle dispersion in which resin particles as a binder resin are dispersed.

The resin particle dispersion is prepared by, for example, dispersing resin particles in a dispersion medium using a surfactant.

Examples of the dispersion medium used for the resin particle dispersion include aqueous mediums.

Examples of the aqueous mediums include water such as distilled water and ion exchange water, and alcohols. These may be used singly or in combination of two or more kinds thereof.

Examples of the surfactant include anionic surfactants such as a sulfuric ester salt, a sulfonate, a phosphate ester, and a soap; cationic surfactants such as an amine salt and a quaternary ammonium salt; and nonionic surfactants such as polyethylene glycol, an ethylene oxide adduct of alkyl phenol, and polyol. Among these, anionic surfactants and cationic surfactants are particularly preferably used. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a DYNO mill having media is exemplified. Depending on the kind of the resin particles, resin particles may be dispersed in the resin particle dispersion according to, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

A volume average particle diameter of the resin particles dispersed in the resin particle dispersion is, for example, preferably 0.01 μm to 1 μm, more preferably 0.08 μm to 0.8 μm, and even more preferably 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement with a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably 5% by weight to 50% by weight, and more preferably 10% by weight to 40% by weight.

For example, the colorant particle dispersion and the release agent particle dispersion are also prepared in the same manner as in the case of the resin particle dispersion. That is, the particles in the resin particle dispersion are the same as the colorant particles dispersed in the colorant particle dispersion and the release agent particles dispersed in the release agent particle dispersion, in terms of the volume average particle diameter, the dispersion medium, the dispersing method, and the content of the particles.

Here, when preparing the crystalline resin particle dispersion, a nucleating agent may be added. Specifically, when preparing the crystalline resin particle dispersion by a phase inversion emulsification method, for example, a nucleating agent is added to a solvent together with the crystalline resin. Accordingly, the nucleating agent is incorporated into the crystalline resin particles. The onset temperature T1 of the endothermic peak having the lowest peak temperature in the first heating step which is measured by differential scanning calorimeter (DSC) regarding the toner particles before storing may be controlled (that is, the value of "T2−T1" may be controlled) depending on the amount of the nucleating agent.

Specifically, when the amount of the nucleating agent with respect to the crystalline resin is large, phase separation between the amorphous resin and the crystalline resin easily occurs in the toner particles, and the onset temperature T1 of the endothermic peak tends to be increased. Meanwhile, when the amount of the nucleating agent with respect to the crystalline resin is excessively large, the nucleating agent is hardly incorporated into the crystalline resin particles.

The amount of the nucleating agent with respect to the crystalline resin is preferably 0.2% by weight to 5% by weight (more preferably 0.3% by weight to 2.5% by weight), from viewpoints of satisfying Expression (1): $2<T2-T1<10$ and preventing occurrence of image deletion and the offset.

The nucleating agent is not particularly limited, and a well-known crystalline nucleating agent (for example, inorganic crystal nucleating agent or organic crystal nucleating agent) which promotes re-crystallization of the crystalline resin is used.

Examples of the inorganic crystal nucleating agent include silica, titania, alumina, talc, kaolin, and alum.

Examples of the organic crystal nucleating agent include a nitrogen-containing compound (aromatic amide compound, fatty acid amide, or the like), a phosphate metal salt compound, lower alkyl dibenzylidene sorbitol, an aluminum benzoate compound, straight-chain fatty acid metal salt, rosin acid partial metal salt, and fatty acid ester.

Aggregated Particle Forming Process

Next, the colorant particle dispersion and the release agent dispersion are mixed together with the resin particle dispersion.

The resin particles, the colorant particles, and the release agent particles are heterogeneously aggregated in the mixed dispersion, thereby forming aggregated particles having a diameter near a target toner particle diameter and including the resin particles, the colorant particles, and the release agent particles.

Specifically, for example, an aggregating agent is added to the mixed dispersion and a pH of the mixed dispersion is adjusted to acidity (for example, the pH is 2 to 5). If necessary, a dispersion stabilizer is added. Then, the mixed dispersion is heated at a temperature of the glass transition temperature of the resin particles (specifically, for example, from a temperature 30° C. lower than the glass transition temperature of the resin particles to 10° C. lower than the glass transition temperature) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to be acidic (for example, the pH is 2 to 5), a dispersion stabilizer may be added if necessary, and then the heating may be performed.

Examples of the aggregating agent include a surfactant having an opposite polarity to the polarity of the surfactant used as the dispersing agent to be added to the mixed dispersion, an inorganic metal salt, and a bi- or higher-valent metal complex. Particularly, when a metal complex is used as the aggregating agent, the amount of the surfactant used is reduced and charging characteristics are improved.

If necessary, an additive may be used which forms a complex or a similar bond with the metal ions of the aggregating agent. A chelating agent is preferably used as the additive.

Examples of the inorganic metal salt include a metal salt such as calcium chloride, calcium nitrate, barium chloride, magnesium chloride, zinc chloride, aluminum chloride, and aluminum sulfate, and inorganic metal salt polymer such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacetic acid (IDA), nitrilotriacetic acid (NTA), and ethylenediaminetetraacetic acid (EDTA).

An addition amount of the chelating agent is, for example, preferably in a range of 0.01 parts by weight to 5.0 parts by weight, and more preferably in a range of 0.1 parts by weight to less than 3.0 parts by weight relative to 100 parts by weight of the resin particles.

Coalescence Process

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the resin particle dispersion in which the resin particles are dispersed with the aggregated particle dispersion to conduct aggregation so that the resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

Here, the resin particles attached to the surface of the aggregated particles may be the amorphous resin particles.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, and suction filtration, pressure filtration, or the like may be performed from the viewpoint of productivity. The method for the drying process is also not particularly limited, and freeze drying, flush drying, fluidized drying, vibration-type fluidized drying, or the like may be performed from a viewpoint of productivity.

Next, a case of preparing the toner particles including the urea-modified polyester resin (urea-modified amorphous polyester resin) will be described.

The toner particles including the urea-modified polyester resin may be obtained by a dissolution and suspension method described below. A method of obtaining toner particles including the urea-modified polyester resin (urea-modified amorphous polyester resin) and an unmodified crystalline polyester resin as binder resins will be described, but toner particles may include an unmodified amorphous polyester resin as the binder resin. A method of obtaining toner particles including a colorant and a release agent will be described, but the colorant and the release agent are components included in the toner particles, if necessary.

Oil-Phase Solution Preparation Process

An oil-phase solution obtained by dissolving or dispersing a toner particle material including an unmodified crystalline polyester resin (hereinafter, also simply referred to as a "crystalline polyester resin"), an amorphous polyester prepolymer including an isocyanate group, an amine compound, a colorant, and a release agent in an organic solvent is prepared (oil-phase solution preparation process). This oil-phase solution preparation process is a process of dissolving or dispersing the toner particle material in an organic solvent to obtain a mixed solution of the toner material.

The oil-phase solution is prepared by methods such as 1) a method of preparing an oil-phase solution by collectively dissolving or dispersing the toner material in an organic solvent, 2) a method of preparing an oil-phase solution by kneading the toner material in advance and dissolving or dispersing the kneaded material in an organic solvent, 3) a method of preparing an oil-phase solution by dissolving the crystalline polyester resin, the amorphous polyester prepolymer including an isocyanate group, and the amine compound in an organic solvent and dispersing a colorant and the release agent in the organic solvent, 4) a method of preparing an oil-phase solution by dispersing a colorant and the release agent in the organic solvent and dissolving the crystalline polyester resin, the amorphous polyester prepolymer including an isocyanate group, and the amine compound in the organic solvent, 5) a method of preparing an oil-phase solution by dissolving or dispersing toner particle materials other than the amorphous polyester prepolymer including an isocyanate group and the amine compound (the crystalline polyester resin, a colorant, and a release agent) in an organic solvent and dissolving the amorphous polyester prepolymer including an isocyanate group and the amine compound in the organic solvent, or 6) a method of preparing an oil-phase solution by dissolving or dispersing toner particle materials other than the amorphous polyester prepolymer including an isocyanate group or the amine compound (the crystalline polyester resin, a colorant, and a release agent) in an organic solvent and dissolving the amorphous polyester prepolymer including an isocyanate group or the amine compound in the organic solvent. The method of preparing the oil-phase solution is not limited thereto.

Examples of the organic solvent of the oil-phase solution include an ester solvent such as methyl acetate or ethyl acetate; a ketone solvent such as methyl ethyl ketone or methyl isopropyl ketone; an aliphatic hydrocarbon solvent such as hexane or cyclohexane; a halogenated hydrocarbon solvent such as dichloromethane, chloroform or trichloroethylene. It is preferable that these organic solvents dissolve the binder resin, a rate of the organic solvent dissolving in water is from approximately 0% by weight to 30% by weight, and a boiling point is equal to or lower than 100° C. Among the organic solvents, ethyl acetate is preferable.

Suspension Preparation Process

Next, a suspension is prepared by dispersing the obtained oil-phase solution in a water-phase solution (suspension preparation process).

A reaction between the amorphous polyester prepolymer including an isocyanate group and the amine compound is performed together with the preparation of the suspension. The urea-modified polyester resin is formed by the reaction. The reaction is performed with at least one reaction of the crosslinking reaction and the extension reaction of molecular chains. The reaction between the amorphous polyester prepolymer including an isocyanate group and the amine compound may be performed with the following organic solvent removing process.

Here, the reaction conditions are selected according to reactivity between the structure of isocyanate group included in the amorphous polyester prepolymer and the amine compound. As an example, a reaction time is preferably 10 minutes to 40 hours and more preferably 2 hours to 24 hours. A reaction temperature is preferably 0° C. to 150° C. and more preferably 40° C. to 98° C. In addition, a well-known catalyst (dibutyltin laurate or di-octyltin laurate) may be used if necessary, in the formation of the urea-modified polyester resin. That is, a catalyst may be added to the oil-phase solution or the suspension.

As the water-phase solution, a water-phase solution obtained by dispersing a particle dispersing agent such as an organic particle dispersing agent or an inorganic particle dispersing agent in an aqueous solvent is used. In addition, as the water-phase solution, a water-phase solution obtained by dispersing a particle dispersing agent in an aqueous solvent and dissolving a polymer dispersing agent in an aqueous solvent is also used. Further, a well-known additive such as a surfactant may be added to the water-phase solution.

As the aqueous solvent, water (for example, generally ion exchange water, distilled water, or pure water) is used. The aqueous solvent may be a solvent containing water and an organic solvent such as alcohol (methanol, isopropyl alcohol, or ethylene glycol), dimethylformamide, tetrahydrofuran, cellosolves (methyl cellosolve), or lower ketones (acetone or methyl ethyl ketone).

As the organic particle dispersing agent, a hydrophilic organic particle dispersing agent is used. As the organic particle dispersing agent, particles of poly (meth)acrylic acid alkyl ester resin (for example, a polymethyl methacrylate resin), a polystyrene resin, or a poly(styrene-acrylonitrile) resin are used. As the organic particle dispersing agent, particles of a styrene acrylic resin are also used.

As the inorganic particle dispersing agent, a hydrophilic inorganic particle dispersing agent is used. Specific examples of the inorganic particle dispersing agent include particles of silica, alumina, titania, calcium carbonate, magnesium carbonate, tricalcium phosphate, clay, diatomaceous earth, or bentonite, and particles of calcium carbonate are preferable. The inorganic particle dispersing agent may be used singly or in combination of two or more kinds thereof.

The surface of the particle dispersing agent may be subjected to surface treatment by a polymer including a carboxyl group.

As the polymer including a carboxyl group, a copolymer of at least one kind selected from salts (alkali metal salt, alkaline earth metal salt, ammonium salt, amine salt) in which α,β-monoethylenically unsaturated carboxylic acid or a carboxyl group of α,β-monoethylenically unsaturated carboxylic acid is neutralized by alkali metal, alkaline earth metal, ammonium, or amine, and α,β-monoethylenically unsaturated carboxylic acid ester is used. As the polymer including a carboxyl group, salt (alkali metal salt, alkaline earth metal salt, ammonium salt, amine salt) in which a carboxyl group of a copolymer of α,β-monoethylenically unsaturated carboxylic acid and α,β-monoethylenically unsaturated carboxylic acid ester is neutralized by alkali metal, alkaline earth metal, ammonium, or amine is also used. The polymer including a carboxyl group may be used singly or in combination with two or more kinds thereof.

Representative examples of α,β-monoethylenically unsaturated carboxylic acid include α,β-unsaturated monocarboxylic acid (acrylic acid, methacrylic acid, or crotonic acid), and α,β-unsaturated dicarboxylic acids (maleic acid, fumaric acid, or itaconic acid). Representative examples of α,β-monoethylenically unsaturated carboxylic acid ester include alkyl esters of (meth)acrylate, (meth)acrylate including an alkoxy group, (meth)acrylate including a cyclohexyl group, (meth)acrylate including a hydroxy group, and polyalkylene glycol mono(meth)acrylate.

As the polymer dispersing agent, a hydrophilic polymer dispersing agent is used. As the polymer dispersing agent, specifically a polymer dispersing agent which includes a carboxyl group and does not include lipophilic group (hydroxypropoxy group or a methoxy group) (for example, water-soluble cellulose ether such as carboxymethyl cellulose or carboxyethyl cellulose) is used.

Solvent Removing Process

Next, a toner particle dispersion is obtained by removing an organic solvent from the obtained suspension (solvent removing process). The solvent removing process is a process of preparing toner particles by removing the organic solvent contained in liquid droplets of the water-phase solution dispersed in the suspension. The method of removing the organic solvent from the suspension may be performed immediately after the suspension preparation process or may be performed after 1 minute or longer, after the suspension preparation process.

In the solvent removing process, the organic solvent may be removed from the suspension by cooling or heating the obtained suspension to have a temperature in a range of 0° C. to 100° C., for example.

As a specific method of the organic solvent removing method, the following method is used.

(1) A method of allowing airflow to blow to the suspension to forcibly update a gas phase on the surface of the suspension. In this case, gas may flow into the suspension.

(2) A method of reducing pressure. In this case, a gas phase on the surface of the suspension may be forcibly updated due to filling of gas or gas may further blow into the suspension.

The toner particles are obtained through the above-mentioned processes.

Here, after the organic solvent removing process ends, the toner particles formed in the toner particle dispersion are subjected to a well-known washing process, a well-known solid-liquid separation process, a well-known drying process, and thereby dried toner particles are obtained.

Regarding the washing process, replacing washing using ion exchanged water may preferably be sufficiently performed for charging properties.

The solid-liquid separation process is not particularly limited, but suction filtration, pressure filtration, or the like may preferably be performed for productivity. The drying process is not particularly limited, but freeze drying, flush drying, fluidized drying, vibrating fluidized drying, and the like may preferably be performed for productivity.

The toner according to the exemplary embodiment is, for example, prepared by adding an external additive to the obtained dry toner particles and mixing the materials. The mixing may be performed in a V blender, a HENSCHEL MIXER, a LÖdige mixer, and the like. Further, if necessary, coarse toner particles may be removed with a vibration classifier, a wind classifier, and the like.

Electrostatic Charge Image Developer

An electrostatic charge image developer according to the exemplary embodiment includes at least the toner according to the exemplary embodiment.

The electrostatic charge image developer according to the exemplary embodiment may be a single-component developer including only the toner according to the exemplary embodiment or may be a two-component developer obtained by mixing the toner and a carrier.

The carrier is not particularly limited and known carriers are exemplified. Examples of the carrier include a coating carrier in which surfaces of cores formed of magnetic particles are coated with a coating resin; magnetic particles dispersion-type carrier in which magnetic particles is dispersed and blended in a matrix resin; and a resin impregnation-type carrier in which porous magnetic particles are impregnated with a resin.

The magnetic particle dispersion-type carrier and the resin impregnation-type carrier may be carriers in which constituent particles of the carrier are cores and coated with a coating resin.

Examples of the magnetic particles include magnetic metals such as iron, nickel, and cobalt, and magnetic oxides such as ferrite and magnetite.

Examples of the resin for coating and matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin configured to include an organosiloxane bond or a modified product thereof, a fluororesin, polyester, polycarbonate, a phenol resin, and an epoxy resin.

The coating resin and the matrix resin may contain other additives such as conductive materials.

Examples of the conductive particles include particles of metals such as gold, silver, and copper, carbon black particles, titanium oxide particles, zinc oxide particles, tin oxide particles, barium sulfate particles, aluminum borate particles, and potassium titanate particles.

Here, a coating method using a coating layer forming solution in which a coating resin, and if necessary, various additives are dissolved in an appropriate solvent is used to coat the surface of a core with the coating resin. The solvent is not particularly limited, and may be selected in consideration of the coating resin to be used, coating suitability, and the like.

Specific examples of the resin coating method include a dipping method of dipping cores in a coating layer forming solution, a spraying method of spraying a coating layer forming solution to surfaces of cores, a fluid bed method of spraying a coating layer forming solution in a state in which cores are allowed to float by flowing air, and a kneader-coater method in which cores of a carrier and a coating layer forming solution are mixed with each other in a kneader-coater and the solvent is removed.

The mixing ratio (weight ratio) between the toner and the carrier in the two-component developer is preferably 1:100 to 30:100, and more preferably 3:100 to 20:100 (toner: carrier).

Image Forming Apparatus and Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that contains a container that contains an electrostatic charge image developer and develops the electrostatic charge image formed on the surface of the image holding member with the electrostatic charge image developer as a toner image, a transfer unit that transfers the toner image formed onto the surface of the image holding member to a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including the processes of: charging a surface of an image holding member; forming an electrostatic charge image on the charged surface of the image holding member; developing the electrostatic charge image formed on the surface of the image holding member with the electrostatic charge image developer according to the exemplary embodiment as a toner image; transferring the toner image formed onto the surface of the image holding member to a surface of a recording medium; and fixing the toner image transferred onto the surface of the recording medium is performed.

As the image forming apparatus according to the exemplary embodiment, a known image forming apparatus is applied, such as a direct transfer type apparatus that directly transfers a toner image formed on a surface of an image holding member onto a recording medium; an intermediate transfer type apparatus that primarily transfers a toner image formed on a surface of an image holding member onto a surface of an intermediate transfer member, and secondarily transfers the toner image transferred to the surface of the intermediate transfer member onto a surface of a recording medium; an apparatus that is provided with a cleaning unit that cleans a surface of an image holding member before charging after transfer of a toner image; or an apparatus that is provided with an erasing unit that irradiates, after transfer of a toner image, a surface of an image holding member with erase light before charging for erasing.

In the case of an intermediate transfer type apparatus, a transfer unit is configured to have, for example, an intermediate transfer member having a surface to which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) that is detachable from the image forming apparatus. As the process cartridge, for example, a process cartridge that includes a container that contains the electrostatic charge image developer according to the exemplary embodiment and is provided with a developing unit is suitably used.

Hereinafter, an example of the image forming apparatus according to the exemplary embodiment will be shown. However, the image forming apparatus is not limited thereto. Main portions shown in the drawing will be described, but descriptions of other portions will be omitted.

FIG. 1 is a schematic configuration diagram showing the image forming apparatus according to the exemplary embodiment.

The image forming apparatus shown in FIG. 1 is provided with first to fourth electrophotographic image forming units 10Y, 10M, 10C, and 10K (image forming units) that output yellow (Y), magenta (M), cyan (C), and black (K) images based on color-separated image data, respectively. These image forming units (hereinafter, may be simply referred to as "units") 10Y, 10M, 10C, and 10K are arranged side by side at predetermined intervals in a horizontal direction. These units 10Y, 10M, 10C, and 10K may be process cartridges that are detachable from the image forming apparatus.

An intermediate transfer belt 20 as an intermediate transfer member is installed above the units 10Y, 10M, 10C, and 10K in the drawing to extend through the units. The intermediate transfer belt 20 is wound on a driving roll 22 and a support roll 24 contacting the inner surface of the intermediate transfer belt 20, which are disposed to be separated from each other on the left and right sides in the drawing, and travels in a direction toward the fourth unit 10K from the first unit 10Y. The support roll 24 is pressed in a direction in which it departs from the driving roll 22 by a spring or the like (not shown), and a tension is given to the intermediate transfer belt 20 wound on both of the rolls. In addition, an intermediate transfer member cleaning device 30 opposed to the driving roll 22 is provided on a surface of the intermediate transfer belt 20 on the image holding member side.

Developing devices (developing units) 4Y, 4M, 4C, and 4K of the units 10Y, 10M, 10C, and 10K are supplied with toner including four color toner, that is, a yellow toner, a magenta toner, a cyan toner, and a black toner accommodated in toner cartridges 8Y, 8M, 8C, and 8K, respectively.

The first to fourth units 10Y, 10M, 10C, and 10K have the same configuration, and accordingly, only the first unit 10Y that is disposed on the upstream side in a traveling direction of the intermediate transfer belt to form a yellow image will be representatively described here. The same parts as in the first unit 10Y will be denoted by the reference numerals with magenta (M), cyan (C), and black (K) added instead of yellow (Y), and descriptions of the second to fourth units 10M, 10C, and 10K will be omitted.

The first unit 10Y has a photoreceptor 1Y acting as an image holding member. Around the photoreceptor 1Y, a charging roll (an example of the charging unit) 2Y that charges a surface of the photoreceptor 1Y to a predetermined potential, an exposure device (an example of the electrostatic charge image forming unit) 3 that exposes the charged surface with laser beams 3Y based on a color-separated image signal to form an electrostatic charge image, a developing device (an example of the developing unit) 4Y that supplies a charged toner to the electrostatic charge image to develop the electrostatic charge image, a primary transfer roll (an example of the primary transfer unit) 5Y that transfers the developed toner image onto the intermediate transfer belt 20, and a photoreceptor cleaning device (an example of the cleaning unit) 6Y that removes the toner remaining on the surface of the photoreceptor 1Y after primary transfer, are arranged in sequence.

The primary transfer roll 5Y is disposed inside the intermediate transfer belt 20 to be provided at a position opposed to the photoreceptor 1Y. Furthermore, bias supplies (not shown) that apply a primary transfer bias are connected to the primary transfer rolls 5Y, 5M, 5C, and 5K, respectively. Each bias supply changes a transfer bias that is applied to each primary transfer roll under the control of a controller (not shown).

Hereinafter, an operation of forming a yellow image in the first unit 10Y will be described.

First, before the operation, the surface of the photoreceptor 1Y is charged to a potential of −600 V to −800 V by the charging roll 2Y.

The photoreceptor 1Y is formed by laminating a photosensitive layer on a conductive substrate (for example, volume resistivity at 20° C.: $1\times10^{-6}$ Ωcm or less). The photosensitive layer typically has high resistance (that is about the same as the resistance of a general resin), but has properties in which when laser beams 3Y are applied, the specific resistance of a part irradiated with the laser beams changes. Accordingly, the laser beams 3Y are output to the charged surface of the photoreceptor 1Y via the exposure device 3 in accordance with image data for yellow sent from the controller (not shown). The laser beams 3Y are applied to the photosensitive layer on the surface of the photoreceptor 1Y, whereby an electrostatic charge image of a yellow image pattern is formed on the surface of the photoreceptor 1Y.

The electrostatic charge image is an image that is formed on the surface of the photoreceptor 1Y by charging, and is a so-called negative latent image, that is formed by irradiating the photosensitive layer with laser beams 3Y so that the specific resistance of the irradiated part is lowered to cause charges to flow on the surface of the photoreceptor 1Y, while charges stay on a part which is not irradiated with the laser beams 3Y.

The electrostatic charge image formed on the photoreceptor 1Y is rotated up to a predetermined developing position with the travelling of the photoreceptor 1Y. The electrostatic charge image on the photoreceptor 1Y is visualized (developed) as a toner image at the developing position by the developing device 4Y.

The developing device 4Y accommodates, for example, an electrostatic charge image developer including at least a yellow toner and a carrier. The yellow toner is frictionally charged by being stirred in the developing device 4Y to have a charge with the same polarity (negative polarity) as the charge that is on the photoreceptor 1Y, and is thus held on the developer roll (an example of the developer holding member). By allowing the surface of the photoreceptor 1Y to pass through the developing device 4Y, the yellow toner electrostatically adheres to the erased latent image part on the surface of the photoreceptor 1Y, whereby the latent image is developed with the yellow toner. Next, the photoreceptor 1Y having the yellow toner image formed thereon continuously travels at a predetermined rate and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y and an electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has the opposite polarity (+) to the toner polarity (−), and, for example, is controlled to +10 μA in the first unit 10Y by the controller (not shown).

On the other hand, the toner remaining on the photoreceptor 1Y is removed and collected by the photoreceptor cleaning device 6Y.

The primary transfer biases that are applied to the primary transfer rolls 5M, 5C, and 5K of the second unit 10M and the subsequent units are also controlled in the same manner as in the case of the first unit.

In this manner, the intermediate transfer belt 20 onto which the yellow toner image is transferred in the first unit 10Y is sequentially transported through the second to fourth units 10M, 10C, and 10K, and the toner images of respective colors are multiply-transferred in a superimposed manner.

The intermediate transfer belt 20 onto which the four color toner images have been multiply-transferred through the first to fourth units reaches a secondary transfer part that is composed of the intermediate transfer belt 20, the support roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the support roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copying machines, printers, and the like. As a recording medium, an OHP sheet is also exemplified other than the recording sheet P.

The surface of the recording sheet P is preferably smooth in order to further improve smoothness of the image surface after fixing. For example, coated paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to the exemplary embodiment will be described.

The process cartridge according to the exemplary embodiment includes a developing unit that includes a container that contains the electrostatic charge image developer according to the exemplary embodiment and develops an electrostatic charge image formed on a surface of an image holding member with the electrostatic charge image developer as a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be shown. However, the process cartridge is not limited thereto. Major parts shown in the drawing will be described, but descriptions of other parts will be omitted.

Figure 2:
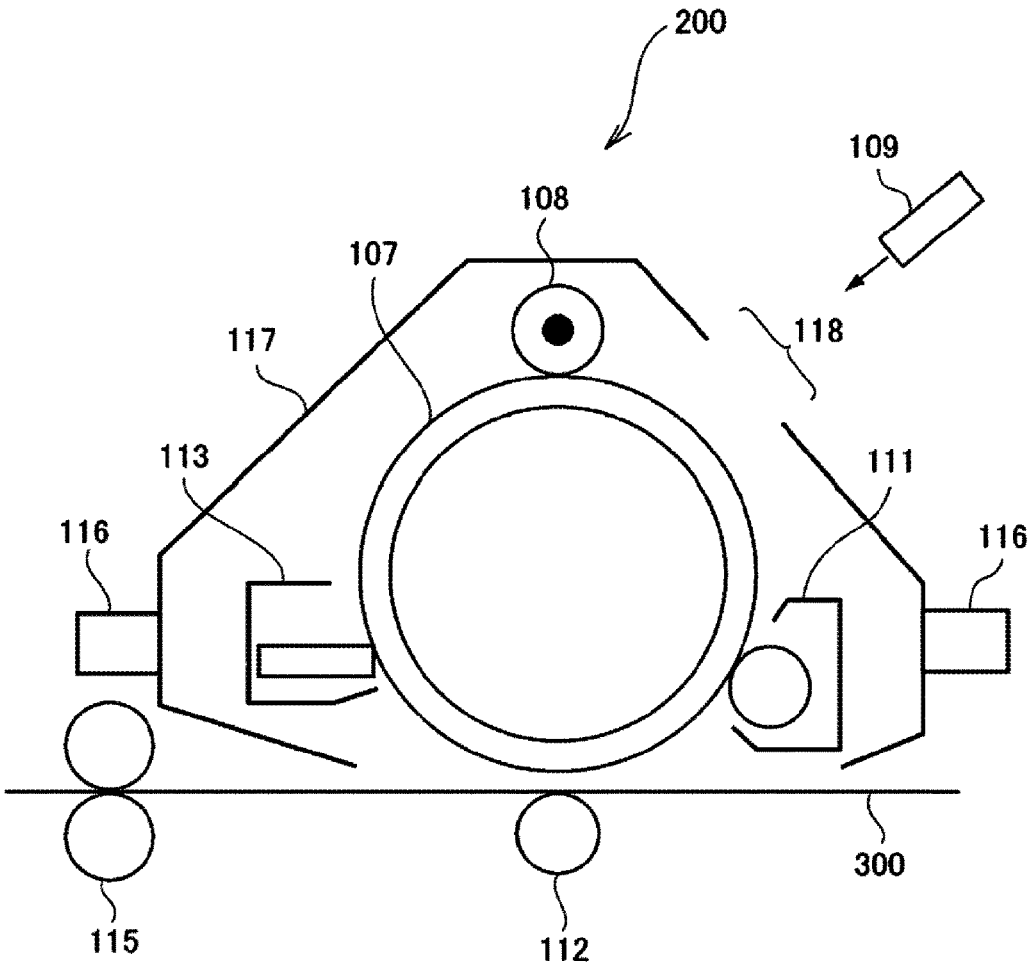
FIG. 2 is a schematic configuration diagram showing a process cartridge according to the exemplary embodiment.

FIG. 2 is a schematic configuration diagram showing the process cartridge according to the exemplary embodiment.

A process cartridge 200 shown in FIG. 2 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment includes a container that contains the toner according to the exemplary embodiment and is detachable from an image forming apparatus. The toner cartridge includes a container that contains a toner for replenishment for being supplied to the developing unit provided in the image forming apparatus.

The image forming apparatus shown in FIG. 1 has such a configuration that the toner cartridges 8Y, 8M, 8C, and 8K are detachable therefrom, and the developing devices 4Y, 4M, 4C, and 4K are connected to the toner cartridges corresponding to the respective developing devices (colors) via toner supply tubes (not shown), respectively. In addition, in a case where the toner accommodated in the toner cartridge runs low, the toner cartridge is replaced.

EXAMPLES

Hereinafter, the exemplary embodiment of the invention will be described in detail using examples and comparative examples, but the exemplary embodiment of the invention is not limited to the examples. Unless specifically noted, "parts" and "%" represent "parts by weight" and "% by weight".

Synthesis of Crystalline Polyester Resin (1)

225 parts of 1,10-dodecanedioic acid, 174 parts of 1,10-decanediol, and 0.8 parts of dibutyl tin oxide as a catalyst are put in a heated and dried three-necked flask, air in the three-necked flask is turned into an inert atmosphere with nitrogen gas by performing pressure reducing operation, the mixture is stirred by mechanical stirring at 180° C. for 5 hours and refluxed to cause the reaction to proceed. During the reaction, water generated in the reaction system is distilled away. After that, the temperature is slowly increased to 230° C. under the reduced pressure, the mixture is stirred for 2 hours. When a viscous state is obtained, a molecular weight thereof is confirmed by GPC, and when a weight average molecular weight thereof is 17,500, distillation under reduced pressure is stopped, and a crystalline polyester resin (1) having a melting temperature of 76° C. is obtained.

Synthesis of Amorphous Polyester Resin (1)

Bisphenol A propylene oxide adduct: 469 parts
Bisphenol A ethylene oxide adduct: 137 parts
Terephthalic acid: 152 parts
Fumaric acid: 75 parts
Dodecenylsuccinic acid: 114 parts
Dibutyltin oxide: 4 parts The components described above are put in a heated and dried three-necked flask, the pressure of air in the vessel is reduced by performing pressure reducing operation, air is turned into an inert atmosphere with nitrogen gas, and the mixture is reacted at 230° C. under ordinary pressure (101.3 kPa) for 10 hours by mechanical stirring and further reacted at 8 kPa for 1 hour. The mixture is cooled to 210° C., 4 parts by weight of trimellitic anhydride is added, a reaction is allowed for 1 hour, the mixture is reacted until a softening temperature becomes 107° C. at 8 kPa, and an amorphous polyester resin (1) is obtained.

Load of 1.96 MPa is applied to a sample by a plunger while heating 1 g of a sample at a rate of temperature rise of 6° C./min using a flow tester (CFT-5000 manufactured by Shimadzu Corporation), the sample is extruded from a nozzle having a diameter of 1 mm and a length of 1 mm, and the softening temperature of the polyester resin is set as a temperature at which the half of the sample flows out.

Synthesis of Amorphous Polyester Resin (2)

An amorphous polyester resin (2) is obtained in the same manner as in the preparation of the amorphous polyester resin (1), except for changing the additive amount of monomer components and the softening temperature at the time of resin extraction as shown in Table 1.

Preparation of Crystalline Polyester Resin Particle Dispersion (1)

100 parts of the crystalline polyester resin (1), 0.5 parts of a nucleating agent (NA-05 manufactured by ADEKA), 40 parts of methyl ethyl ketone, and 30 parts of isopropyl alcohol, are put in a separable flask, mixed and dissolved with each other at 75° C., and 6.0 parts of 10 weight % ammonia aqueous solution is added dropwise. The heating temperature is decreased to 60° C., ion exchange water is added dropwise at a liquid transport speed of 6 g/min using a liquid transport pump while stirring the mixture. After the liquid become clouded, the liquid transport speed is increased to 25 g/min, and when the total liquid amount becomes 400 parts, the dropwise adding of ion exchange water is stopped. Then, the solvent is removed under the reduced pressure, and a crystalline polyester resin particle dispersion (1) is obtained. Regarding the "crystalline polyester resin particles" in the obtained crystalline polyester resin particle dispersion, the volume average particle diameter is 168 nm and the solid content concentration is 11.5% by weight.

Preparation of Crystalline Polyester Resin Particle Dispersions (2) to (8)

Crystalline polyester resin particle dispersions (2) to (8) are obtained in the same manner as in the preparation of the crystalline polyester resin particle dispersion (1), except for changing the kind and additive amount of the nucleating agent used as shown in Table 2.

Preparation of Amorphous Polyester Resin Particle Dispersion (1)

Amorphous polyester resin (1): 300 parts
Methyl ethyl ketone: 150 parts
Isopropanol: 50 parts
10 weight % ammonia aqueous solution: 10.6 parts The components described above (after removing insoluble portions regarding the amorphous polyester resin) are put in a separable flask, mixed, and dissolved, and ion exchange water is added dropwise thereto at liquid transport speed of 8 g/min using a liquid transport pump while heating and stirring the mixture at 40° C. After the liquid become clouded, the liquid transport speed is increased to 12 g/min to allow phase inversion, and when the total liquid amount becomes 1050 parts, the dropwise adding is stopped. Then, the solvent is removed under the reduced pressure, and an amorphous polyester resin particle dispersion (1) is obtained. Regarding the amorphous polyester resin particle dispersion (1), the volume average particle diameter is 168 nm and the solid content concentration is 30.6% by weight.

Preparation of Amorphous Polyester Resin Particle Dispersion (2)

An amorphous polyester resin particle dispersion (2) is obtained in the same manner as in the preparation of the amorphous polyester resin particle dispersion (1), except for changing the kind of the amorphous polyester resin, and the amounts of methyl ethyl ketone, isopropanol, and an ammonia aqueous solution as shown in Table 3.

Preparation of Cyan Pigment Particle Dispersion

Pigment Blue 15:3 (manufactured by DIC Corporation): 200 parts
Anionic surfactant (manufactured by DKS Co., Ltd., NEOGEN R): 1.5 parts
Ion exchange water: 800 parts The above components are mixed with each other and dispersed using a dispersing machine CAVITRON (CR 1010 manufactured by Pacific Machinery & Engineering Co., Ltd.) for approximately 1 hour, and a Cyan pigment particle dispersion (solid content concentration: 20%) is prepared.

Preparation of Release Agent Particle Dispersion

Paraffin Wax HNP 9 (manufactured by Nippon Seiro Co., Ltd.): 500 parts
Anionic surfactant (NEOGEN RK manufactured by DKS Co., Ltd.): 50 parts
Ion exchange water: 1,700 parts The above components are heated to 110° C. and dispersed using a homogenizer (ULTRA TURRAX T50 manufactured by IKA Works, Inc.). After that, the mixture is subject to dispersion treatment with MANTON-GAULIN HIGH PRESSURE HOMOGENIZER (manufactured by Gaulin Co., Ltd.), and a release agent particle dispersion (solid content concentration: 32% by weight) in which release agent particles having an average particle diameter of 180 nm are dispersed is prepared.

Preparation of Cyan toner (1)

Amorphous polyester resin particle dispersion (1): 207 parts
Amorphous polyester resin particle dispersion (2): 207 parts
Crystalline polyester resin particle dispersion (1): 186 parts
Cyan pigment particle dispersion: 80 parts
Release agent particle dispersion: 62 parts
Nonionic surfactant (IGEPAL CA 897): 1.40 parts The raw materials (hereinafter also referred to as "raw material preparation") are put in a 2 L cylindrical stainless steel vessel and dispersed and mixed with each other for 10 minutes while applying a shear force at 4000 rpm by a homogenizer (ULTRA TURRAX T50 manufactured by IKA Works, Inc.). Then, 1.75 parts of 10% nitric acid aqueous solution of polyaluminum chloride is slowly added dropwise as an aggregating agent, the resultant material is dispersed and mixed with each other for 15 minutes by setting a rotating rate of the homogenizer as 5000 rpm, and a raw material dispersion is obtained.

After that, the raw material dispersion is put in a polymerization tank including a stirring device using stirring blades of two paddles and a thermometer, and started to be heated with a mantle heater by setting a stirring rotation rate as 550 rpm to promote the growth of aggregated particles at 49° C. At this time, pH of the raw material dispersion is controlled to be in a range of 2.2 to 3.5 with 0.3 N nitric acid and 1 N sodium hydroxide aqueous solution. The raw material dispersion is held in the pH range described above for 2 hours and aggregated particles are formed.

Then, 75 parts of the amorphous polyester resin particle dispersion (1) and 75 parts of the amorphous polyester resin particle dispersion (2) are added to cause the amorphous polyester resin particles to be attached to the surfaces of the aggregated particles. The temperature thereof is increased to 53° C., the aggregated particles are prepared while confirming the size and form of the particle with an optical microscope and MULTISIZER II. After that, the pH thereof is adjusted to 7.8 using 5% sodium hydroxide aqueous solution and held for 15 minutes. Then, after increasing the pH to 8.0 for coalescing the aggregated particles, the temperature thereof is increased to 85° C. After confirming that the aggregated particles are coalesced using the optical microscope, the heating is stopped after 2 hours, and cooling is performed to 55° C. at a rate of temperature decrease of 1.0° C./min, then, the rate of temperature decrease is changed to 0.3° C./min and the cooling is performed to 30° C. Then, after performing sieving with mesh of 20 μm and repeating water washing, the resultant material is dried with a vacuum drying machine to obtain Cyan toner particles (1).

0.5% by weight of hexamethyldisilazane-treated silica (average particle diameter of 40 nm) and 0.7% by weight of a titanium compound (average particle diameter of 30 nm) obtained by performing treatment of 50% of isobutyltrimethoxysilane with respect to metatitanic acid and firing are added to the obtained Cyan toner particles (1) as external additives (both amounts of external additives externally added are weight ratios with respect to the toner particles), mixed with each other in a 75 L HENSCHEL MIXER for 10 minutes, and sieved using a wind classfier HI-BOLTER 300 (manufactured by Shin Tokyo Kikai), and a Cyan toner (1) is prepared. A volume average particle diameter of the obtained Cyan toner (1) is 5.8

Preparation of Cyan Toners (2) to (5) and (7) to (14)

Cyan toners (2) to (5) and (7) to (14) are prepared in the same manner as in the preparation of the Cyan toner (1), except for changing the kind and additive amount of the crystalline polyester resin dispersion used and the additive amount of the amorphous polyester resin dispersion in the raw material preparation as shown in Table 4.

Preparation of Cyan Toner (6)

A Cyan toner (6) is prepared in the same manner as in the preparation of the Cyan toner (5), except for stopping the heating after 2 hours, after confirming the coalescing of the aggregated particles, and performing the cooling to 30° C. at a rate of temperature decrease of 0.3° C./min.

Preparation of Cyan Developer (1)

First, coating of 0.15 parts of vinylidene fluoride and 1.35 parts of a copolymer (polymerization ratio of 80:20) resin of methyl methacrylate and trifluoroethylene is performed with respect to 100 parts of ferrite cores having an average particle diameter of 35 μm using a kneader, and a carrier is prepared.

The obtained carrier and the Cyan toner (1) are mixed with each other in a 2 liter V blender at a ratio of 100 parts:8 parts, and a Cyan developer (1) is prepared.

Preparation of Cyan Developers (2) to (14)

Cyan developers (2) to (14) are prepared in the same manner as in the preparation of the Cyan developer (1), except for changing the Cyan toner (1) used as the Cyan toners (2) to (14).

Examples 1 to 12 and Comparative Examples 1 and 2

The Cyan developers (1) to (14) are used as developers of Examples and Comparative Examples, and the following measurement and evaluation are performed.

Measurement

Regarding the toner of the developer of each example, an onset temperature T1 (° C.) of an endothermic peak having the lowest peak temperature in a first heating step which is measured by differential scanning calorimeter (DSC) regarding the toner particles before storing [in the table, simply shown as "T1"] and an onset temperature T2 (° C.) of an endothermic peak having the lowest peak temperature in a first heating step which is measured by differential scanning calorimeter (DSC) regarding the toner particles after storing [in the table, simply shown as "T2"] are obtained.

In addition, the measurement regarding the toner particles before storing is performed by differential scanning calorimeter (DSC) according to the method described above, and an endothermic amount S1 derived from the crystalline resin in a first heating process [in the table, simply shown as "S1"] and an endothermic amount S2 derived from the crystalline resin in a second heating step [in the table, simply shown as "S2"] are obtained.

The results thereof are shown in Table 5.

Evaluation

Image Forming

Figure 4:
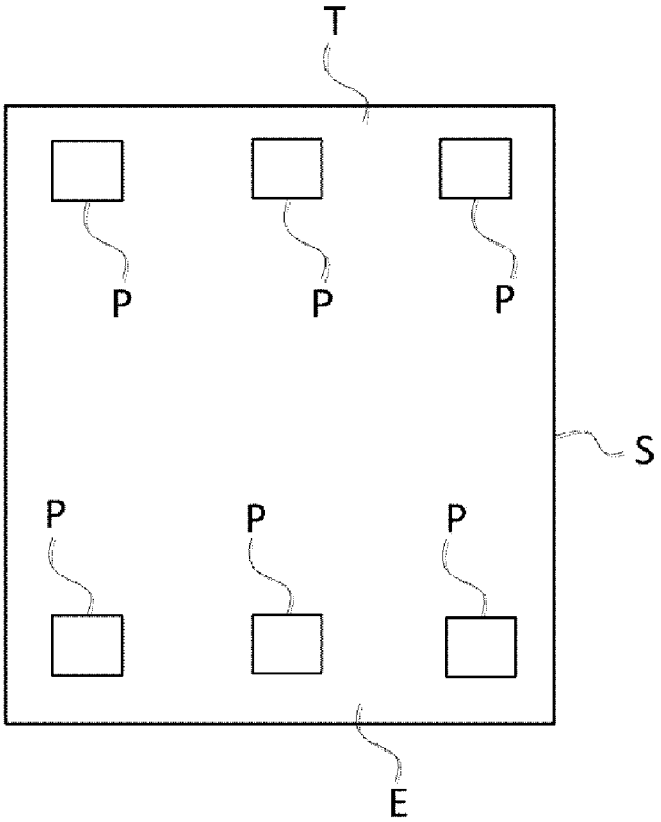
FIG. 4 is a schematic diagram for explaining an image chart formed in evaluation of the examples.

A developing unit of each developing device of a remodeled machine of ApeosPort-V C7775 manufactured by Fuji Xerox Co., Ltd. is filled with each of the Cyan developers, and a toner applied amount of a solid portion is adjusted to be 12 g/m$^2$. As evaluation charts, a chart in which a solid image patches are disposed at front end portion/rear end portion of an A3-sized sheet (front end portion and rear end portion in a paper feeding direction) with a front margin of 15 mm and a rear margin of 10 mm (see FIG. 4. Here, in FIG. 4, S indicates a sheet, T indicates a front end of the sheet, E indicates a rear end of the sheet, and P indicates a solid image patch), and a chart of an A3-sized entire solid image are used. 1000 sheets of the image charts are continuously printed in an environment of a temperature of 15° C. and a humidity of 10% (low temperature and low humidity environment) and an environment of a temperature of 32° C. and a humidity of 80% (high temperature and high humidity environment), and the evaluation is performed regarding the following items. The results thereof are shown in Table 5 to Table 7. As the evaluation sheet, Premier TCF (80 gsm) (manufactured by Fuji Xerox Co., Ltd.) is used.

Evaluation of Offset

Each solid images on the front end/rear end of the sheet are visually observed, and degrees of occurrence of deletion, roughening, and fine split of images are evaluated with the following evaluation criteria.

A: No deletion, roughening, and fine split of images are observed.

B: Image roughening is extremely slightly observed but in an acceptable level.

C: At least any one of deletion, roughening, and fine split of images is slightly observed.

D: At least any one of deletion, roughening, and fine split of images is observed.

Evaluation of Anti-Crease Performance

Each solid image on the front end/rear end of the sheet is folded to the inner side, a load is applied thereto with pressure of 10 g/cm$^2$ for 1 minute, the folded portion is opened, and the folded portion is softly wiped with gauze. At this time, a degree of image deletion is visually observed with the following evaluation criteria.

A: No image deletion

B: creases are slightly observed (width equal to or smaller than 100 μm)

C: Lack of image is observed, but in an acceptable range (width equal to or smaller than 500 μm)

D: Image defects are significant and it is not in an acceptable range (width exceeding 500 μm)

Evaluation of Image Deletion (White Spots)

The entire solid image chart is visually observed and a degree of white spots of the image is evaluated with the following evaluation criteria.

G1: Plural parts of image deletion with white spots are observed on the entire surface of the image.

G2: Several parts of image deletion with white spots may be confirmed.

G3: Image deletion with white spots is slightly observed, but in an acceptable level G4: No image deletion with white spots Hereinafter, the details of Examples and Comparative Examples are shown in Table 1 to Table 7 as lists.

In the tables, "PE" indicates "polyester".

TABLE 1

| | Bisphenol A propylene oxide adduct (part) | Bisphenol A ethylene oxide adduct (part) | Terephthalic acid (part) | Trimellitic anhydride (part) | Fumaric acid (part) | Dodecenyl-succinic acid (part) | Dibutyltin oxide (part) | Glass transition temperature (° C.) | Softening temperature (° C.) |
|---|---|---|---|---|---|---|---|---|---|
| Amorphous PE resin (1) | 469 | 137 | 152 | 4 | 75 | 114 | 4 | 57 | 107 |
| Amorphous PE resin (2) | 367 | 230 | 163 | 20 | 12 | 227 | 4 | 62 | 118 |

TABLE 2

| | Crystalline PE resin | Kind of nucleating agent | Amount of nucleating agent added (part) | Volume average particle diameter (nm) | Solid content concentration (% by weight) |
|---|---|---|---|---|---|
| Crystalline PE resin particle dispersion (1) | Crystalline PE resin (1) | NA-05 (manufactured by ADEKA) | 0.5 | 168 | 11.5 |
| Crystalline PE resin particle dispersion (2) | Crystalline PE resin (1) | NA-05 (manufactured by ADEKA) | 1.5 | 174 | 11.5 |
| Crystalline PE resin particle dispersion (3) | Crystalline PE resin (1) | NA-05 (manufactured by ADEKA) | 2.5 | 180 | 11.5 |
| Crystalline PE resin particle dispersion (4) | Crystalline PE resin (1) | NA-05 (manufactured by ADEKA) | 3 | 197 | 11.5 |
| Crystalline PE resin particle dispersion (5) | Crystalline PE resin (1) | NA-05 (manufactured by ADEKA) | 0 | 168 | 11.5 |
| Crystalline PE resin particle dispersion (6) | Crystalline PE resin (1) | NA-05 (manufactured by ADEKA) | 1.0 | 178 | 11.5 |
| Crystalline PE resin particle dispersion (7) | Crystalline PE resin (1) | GEL ALL D (manufactured by New Japan Chemical Co., Ltd.) | 0.5 | 168 | 11.5 |
| Crystalline PE resin particle dispersion (8) | Crystalline PE resin (1) | MT-50B (manufactured by Tayca Corporation) | 0.5 | 168 | 11.5 |

TABLE 3

| | Amorphous PE resin | Methyl ethyl ketone (part) | Isopropanol (part) | Ammonia aqueous solution (part) | Volume average particle diameter (nm) | Solid content concentration (% by weight) |
|---|---|---|---|---|---|---|
| Amorphous PE resin particle dispersion (1) | Amorphous PE resin (1) | 150 | 50 | 10.6 | 165 | 30.6 |
| Amorphous PE resin particle dispersion (2) | Amorphous PE resin (2) | 218 | 60 | 10.6 | 164 | 30.6 |

TABLE 4

| | | Amorphous PE resin particle dispersion (1) | Amorphous PE resin particle dispersion (2) | Crystalline PE resin particle dispersion | | Volume average particle diameter | T1 | T2 | T2 − T1 | S1 | S2 | |
|---|---|---|---|---|---|---|---|---|---|---|---|---|
| | | Part | Part | Kind | Part | (μm) | (° C.) | (° C.) | (° C.) | (J/g) | (J/g) | S2/S1 |
| Cyan toner (1) | Cyan toner particles (1) | 207 | 207 | (1) | 186 | 5.8 | 60.2 | 54.5 | 5.8 | −9.3 | −0.92 | 0.1 |
| Cyan toner (2) | Cyan toner particles (2) | 201 | 201 | (1) | 219 | 5.8 | 61.2 | 59 | 2.2 | −13.4 | −0.96 | 0.07 |
| Cyan toner (3) | Cyan toner particles (3) | 214 | 214 | (1) | 152 | 5.8 | 59.2 | 49.9 | 9.3 | −5.1 | −0.88 | 0.17 |
| Cyan toner (4) | Cyan toner particles (4) | 214 | 214 | (2) | 152 | 5.8 | 59.2 | 52.1 | 7.1 | −7.5 | −0.88 | 0.12 |
| Cyan toner (5) | Cyan toner particles (5) | 217 | 217 | (3) | 135 | 5.8 | 58.7 | 52.9 | 5.8 | −8.8 | −0.86 | 0.1 |
| Cyan toner (6) | Cyan toner particles (6) | 217 | 217 | (3) | 135 | 5.8 | 58.7 | 52.9 | 5.8 | −8.8 | −3.5 | 0.4 |

TABLE 4-continued

| | | Amorphous PE resin particle dispersion (1) | Amorphous PE resin particle dispersion (2) | Crystalline PE resin particle dispersion | | Volume average particle diameter | T1 | T2 | T2 − T1 | S1 | S2 | |
|---|---|---|---|---|---|---|---|---|---|---|---|---|
| | | Part | Part | Kind | Part | (μm) | (° C.) | (° C.) | (° C.) | (J/g) | (J/g) | S2/S1 |
| Cyan toner (7) | Cyan toner particles (7) | 204 | 204 | (4) | 203 | 5.8 | 60.7 | 59.1 | 1.6 | −14.1 | −0.94 | 0.07 |
| Cyan toner (8) | Cyan toner particles (8) | 207 | 207 | (5) | 186 | 5.8 | 60.2 | 47.3 | 12.9 | −9.3 | −0.92 | 0.1 |
| Cyan toner (9) | Cyan toner particles (9) | 204 | 204 | (6) | 203 | 5.8 | 60.7 | 57.2 | 3.5 | −11.8 | −0.94 | 0.08 |
| Cyan toner (10) | Cyan toner particles (10) | 210 | 210 | (1) | 169 | 5.8 | 59.7 | 52.2 | 7.5 | −7.2 | −0.90 | 0.13 |
| Cyan toner (11) | Cyan toner particles (11) | 204 | 204 | (2) | 203 | 5.8 | 60.7 | 57.7 | 3.0 | −12.4 | −0.94 | 0.08 |
| Cyan toner (12) | Cyan toner particles (12) | 214 | 214 | (6) | 152 | 5.8 | 59.2 | 51.0 | 8.2 | −6.3 | −0.88 | 0.14 |
| Cyan toner (13) | Cyan toner particles (13) | 207 | 207 | (1) | 186 | 5.8 | 60.2 | 54 | 6.2 | −9.3 | −0.92 | 0.1 |
| Cyan toner (14) | Cyan toner particles (14) | 207 | 207 | (1) | 186 | 5.8 | 60.2 | 55.1 | 5.1 | −9.3 | −0.92 | 0.1 |

TABLE 5

| | | Offset Low temperature and low humidity | | | | | | | | | |
|---|---|---|---|---|---|---|---|---|---|---|---|
| | | Paper front end | | | | | Paper rear end | | | | |
| | | First sheet | Second sheet | Fifth sheet | Tenth sheet | Fiftieth sheet | First sheet | Second sheet | Fifth sheet | Tenth sheet | Fiftieth sheet |
| Example 1 | Cyan developer 1 | A | A | A | A | A | A | A | A | A | A |
| Example 2 | Cyan developer 2 | A | A | A | A | A | B | A | A | A | A |
| Example 3 | Cyan developer 3 | A | A | A | A | A | A | A | A | A | A |
| Example 4 | Cyan developer 4 | A | A | A | A | A | A | A | A | A | A |
| Example 5 | Cyan developer 5 | A | A | A | A | A | A | A | A | A | A |
| Example 6 | Cyan developer 6 | A | A | A | A | A | A | A | A | A | A |
| Comparative Example 1 | Cyan developer 7 | B | B | A | A | A | D | C | B | A | A |
| Comparative Example 2 | Cyan developer 8 | A | A | A | A | A | A | A | A | A | A |
| Example 7 | Cyan developer 9 | A | A | A | A | A | A | A | A | A | A |
| Example 8 | Cyan developer 10 | A | A | A | A | A | A | A | A | A | A |
| Example 9 | Cyan developer 11 | A | A | A | A | A | B | A | A | A | A |
| Example 10 | Cyan developer 12 | A | A | A | A | A | A | A | A | A | A |
| Example 11 | Cyan developer 13 | A | A | A | A | A | A | A | A | A | A |
| Example 12 | Cyan developer 14 | A | A | A | A | A | A | A | A | A | A |

| | | Offset High temperature and high humidity | | | | | | | | | |
|---|---|---|---|---|---|---|---|---|---|---|---|
| | | Paper front end | | | | | Paper rear end | | | | |
| | | First sheet | Second sheet | Fifth sheet | Tenth sheet | Fiftieth sheet | First sheet | Second sheet | Fifth sheet | Tenth sheet | Fiftieth sheet |
| Example 1 | Cyan developer 1 | A | A | A | A | A | A | A | A | A | A |
| Example 2 | Cyan developer 2 | A | A | A | A | A | A | A | A | A | A |
| Example 3 | Cyan developer 3 | A | A | A | A | A | A | A | A | A | A |
| Example 4 | Cyan developer 4 | A | A | A | A | A | A | A | A | A | A |
| Example 5 | Cyan developer 5 | A | A | A | A | A | A | A | A | A | A |
| Example 6 | Cyan developer 6 | A | A | A | A | A | A | A | A | A | A |
| Comparative Example 1 | Cyan developer 7 | A | A | A | A | A | B | A | A | A | A |
| Comparative Example 2 | Cyan developer 8 | A | A | A | A | A | A | A | A | A | A |
| Example 7 | Cyan developer 9 | A | A | A | A | A | A | A | A | A | A |
| Example 8 | Cyan developer 10 | A | A | A | A | A | A | A | A | A | A |
| Example 9 | Cyan developer 11 | A | A | A | A | A | A | A | A | A | A |
| Example 10 | Cyan developer 12 | A | A | A | A | A | A | A | A | A | A |
| Example 11 | Cyan developer 13 | A | A | A | A | A | A | A | A | A | A |
| Example 12 | Cyan developer 14 | A | A | A | A | A | A | A | A | A | A |

TABLE 6

| | | Anti-crease performance Low temperature and low humidity | | | | | | | | | |
|---|---|---|---|---|---|---|---|---|---|---|---|
| | | Paper front end | | | | | Paper rear end | | | | |
| | | First sheet | Second sheet | Fifth sheet | Tenth sheet | Fiftieth sheet | First sheet | Second sheet | Fifth sheet | Tenth sheet | Fiftieth sheet |
| Example 1 | Cyan developer 1 | A | A | A | A | A | A | A | A | A | A |
| Example 2 | Cyan developer 2 | A | A | A | A | A | A | A | A | A | A |
| Example 3 | Cyan developer 3 | A | A | A | A | A | A | A | A | A | A |
| Example 4 | Cyan developer 4 | A | A | A | A | A | A | A | A | A | A |
| Example 5 | Cyan developer 5 | A | A | A | A | A | A | A | A | A | A |
| Example 6 | Cyan developer 6 | B | A | A | A | A | C | B | A | A | A |
| Comparative Example 1 | Cyan developer 7 | A | A | A | A | A | A | A | A | A | A |
| Comparative Example 2 | Cyan developer 8 | A | A | A | A | A | A | A | A | A | A |
| Example 7 | Cyan developer 9 | A | A | A | A | A | A | A | A | A | A |
| Example 8 | Cyan developer 10 | A | A | A | A | A | A | A | A | A | A |
| Example 9 | Cyan developer 11 | A | A | A | A | A | A | A | A | A | A |
| Example 10 | Cyan developer 12 | A | A | A | A | A | A | A | A | A | A |
| Example 11 | Cyan developer 13 | A | A | A | A | A | A | A | A | A | A |
| Example 12 | Cyan developer 14 | A | A | A | A | A | A | A | A | A | A |

| | | Anti-crease performance High temperature and high humidity | | | | | | | | | |
|---|---|---|---|---|---|---|---|---|---|---|---|
| | | Paper front end | | | | | Paper rear end | | | | |
| | | First sheet | Second sheet | Fifth sheet | Tenth sheet | Fiftieth sheet | First sheet | Second sheet | Fifth sheet | Tenth sheet | Fiftieth sheet |
| Example 1 | Cyan developer 1 | A | A | A | A | A | A | A | A | A | A |
| Example 2 | Cyan developer 2 | A | A | A | A | A | A | A | A | A | A |
| Example 3 | Cyan developer 3 | A | A | A | A | A | A | A | A | A | A |
| Example 4 | Cyan developer 4 | A | A | A | A | A | A | A | A | A | A |
| Example 5 | Cyan developer 5 | A | A | A | A | A | A | A | A | A | A |
| Example 6 | Cyan developer 6 | A | A | A | A | A | A | A | A | A | A |
| Comparative Example 1 | Cyan developer 7 | A | A | A | A | A | A | A | A | A | A |
| Comparative Example 2 | Cyan developer 8 | A | A | A | A | A | A | A | A | A | A |
| Example 7 | Cyan developer 9 | A | A | A | A | A | A | A | A | A | A |
| Example 8 | Cyan developer 10 | A | A | A | A | A | A | A | A | A | A |
| Example 9 | Cyan developer 11 | A | A | A | A | A | A | A | A | A | A |
| Example 10 | Cyan developer 12 | A | A | A | A | A | A | A | A | A | A |
| Example 11 | Cyan developer 13 | A | A | A | A | A | A | A | A | A | A |
| Example 12 | Cyan developer 14 | A | A | A | A | A | A | A | A | A | A |

TABLE 7

| | | Image deletion (white spots) | | | | | | | | | |
|---|---|---|---|---|---|---|---|---|---|---|---|
| | | Low temperature and low humidity | | | | | High temperature and high humidity | | | | |
| | | First sheet | Tenth sheet | 100-th sheet | 500-th sheet | 1000-th sheet | First sheet | Tenth sheet | 100-th sheet | 500-th sheet | 1000-th sheet |
| Example 1 | Cyan developer 1 | G4 | G4 | G4 | G4 | G4 | G4 | G4 | G4 | G4 | G4 |
| Example 2 | Cyan developer 2 | G4 | G4 | G4 | G4 | G4 | G4 | G4 | G4 | G4 | G4 |
| Example 3 | Cyan developer 3 | G4 | G4 | G4 | G4 | G4 | G4 | G4 | G4 | G3 | G3 |
| Example 4 | Cyan developer 4 | G4 | G4 | G4 | G4 | G4 | G4 | G4 | G4 | G4 | G4 |
| Example 5 | Cyan developer 5 | G4 | G4 | G4 | G4 | G4 | G4 | G4 | G4 | G4 | G4 |
| Example 6 | Cyan developer 6 | G4 | G4 | G4 | G4 | G4 | G4 | G4 | G4 | G4 | G4 |
| Comparative Example 1 | Cyan developer 7 | G4 | G4 | G4 | G4 | G4 | G4 | G4 | G4 | G4 | G4 |
| Comparative Example 2 | Cyan developer 8 | G4 | G4 | G4 | G4 | G3 | G4 | G4 | G3 | G2 | G1 |
| Example 7 | Cyan developer 9 | G4 | G4 | G4 | G4 | G4 | G4 | G4 | G4 | G4 | G4 |
| Example 8 | Cyan developer 10 | G4 | G4 | G4 | G4 | G4 | G4 | G4 | G4 | G4 | G4 |
| Example 9 | Cyan developer 11 | G4 | G4 | G4 | G4 | G4 | G4 | G4 | G4 | G4 | G4 |
| Example 10 | Cyan developer 12 | G4 | G4 | G4 | G4 | G4 | G4 | G4 | G4 | G3 | G3 |
| Example 11 | Cyan developer 13 | G4 | G4 | G4 | G4 | G4 | G4 | G4 | G4 | G4 | G4 |
| Example 12 | Cyan developer 14 | G4 | G4 | G4 | G4 | G4 | G4 | G4 | G4 | G4 | G4 |

From the results described above, it is found that, in Examples, the offset and the image deletion (white spots) are prevented, compared to a case of Comparative Examples.

In addition, it is also found that, in Examples, anti-crease performance is also excellent.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles including an amorphous resin and a crystalline resin, wherein the amorphous resin is at least one selected from the group consisting of an amorphous polyester resin, an amorphous vinyl resin, an epoxy resin, a polycarbonate resin, and a polyurethane resin, a nucleating agent, wherein an amount of the nucleating agent with respect to the crystalline resin is 0.3% by weight to 2.5% by weight, and wherein when the toner particles are subjected to a measurement by differential scanning calorimetry (DSC) before and after being stored at a temperature of 50° C. and a humidity of 90% RH for 24 hours, a relationship between an onset temperature T1 (° C.) of an endothermic peak having the lowest peak temperature in a first heating step with respect to the toner particles before being stored and an onset temperature T2 (° C.) of an endothermic peak having the lowest peak temperature in a first heating step with respect to the toner particles after being stored satisfies Expression (12): $3 \leq T2-T1 \leq 8$.

2. The electrostatic charge image developing toner according to claim 1, wherein, with respect to the toner particles before being stored, a relationship between an endothermic amount S1 (J/g) derived from the crystalline resin in a first heating process and an endothermic amount S2 (J/g) derived from the crystalline resin in a second heating step satisfies Expression (2): $S2/S1<0.3$.

3. The electrostatic charge image developing toner according to claim 1, wherein a weight ratio between the amorphous resin and the crystalline resin (amorphous resin/crystalline resin) is from 50/50 to 97/3.

4. The electrostatic charge image developing toner according to claim 1, wherein the crystalline resin is a crystalline polyester resin having a melting temperature of 60° C. to 85° C.

5. The electrostatic charge image developing toner according to claim 1, wherein a weight average molecular weight of the crystalline resin is from 6,000 to 35,000.

6. The electrostatic charge image developing toner according to claim 1, wherein a difference between an SP value of the crystalline resin and an SP value of the amorphous resin is from 0.2 to 1.3.

7. An electrostatic charge image developer comprising:

the electrostatic charge image developing toner according to claim 1.

8. A toner cartridge comprising:

a container that contains the electrostatic charge image developing toner according to claim 1, wherein the toner cartridge is detachable from an image forming apparatus.

9. The electrostatic charge image developing toner according to claim 1, wherein the nucleating agent is at least one selected from the group consisting of silica, titania, alumina, talc, kaolin, alum, a nitrogen-containing compound, a phosphate metal salt compound, lower alkyl dibenzylidene sorbitol, an aluminum benzoate compound, rosin acid partial metal salt, and fatty acid ester.

* * * * *